US006926382B2

(12) United States Patent
Ito et al.

(10) Patent No.: US 6,926,382 B2
(45) Date of Patent: Aug. 9, 2005

(54) INK-JET HEAD AND INK-JET PRINTER

(75) Inventors: Atsushi Ito, Nagoya (JP); Yoshikazu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 99 days.

(21) Appl. No.: 10/419,732

(22) Filed: Apr. 22, 2003

(65) Prior Publication Data

US 2003/0202051 A1 Oct. 30, 2003

(30) Foreign Application Priority Data

Apr. 25, 2002 (JP) ..... 2002-123363
May 16, 2002 (JP) ..... 2002-141244

(51) Int. Cl.[7] ..... B41J 2/165
(52) U.S. Cl. ..... 347/29
(58) Field of Search ..... 347/42–44, 47, 347/55, 56, 73, 29

(56) References Cited

U.S. PATENT DOCUMENTS

| | | | | |
|---|---|---|---|---|
| 4,716,423 A | | 12/1987 | Chan et al. | |
| 5,894,316 A | * | 4/1999 | Sakai et al. | 347/54 |
| 5,992,965 A | * | 11/1999 | Katayanagi et al. | 347/29 |
| 2001/0020968 A1 | | 9/2001 | Isono et al. | |

FOREIGN PATENT DOCUMENTS

| | | |
|---|---|---|
| EP | 0 413 340 A1 | 2/1991 |
| EP | 0 600 382 A2 | 6/1994 |
| EP | 1 077 331 A2 | 2/2001 |
| EP | 1 136 269 A2 | 9/2001 |
| EP | 1 164 015 A1 | 12/2001 |
| JP | A 9-156095 | 6/1997 |
| JP | A 10-119268 | 5/1998 |
| JP | A 2000-71443 | 3/2000 |
| JP | A 2001-246744 | 9/2001 |
| JP | A 2002-79664 | 3/2002 |
| WO | WO 01/54851 A2 | 8/2001 |

* cited by examiner

*Primary Examiner*—Shih-Wen Hsieh
(74) *Attorney, Agent, or Firm*—Oliff & Berridge, PLC

(57) ABSTRACT

An ink-jet head comprises pressure chambers arranged along a first flat face, and nozzles each open in a second flat face opposing to the first flat face. The nozzles are connected to the respective pressure chambers. The ink-jet head further comprises a common ink chamber extending along an arrangement of the nozzles. The common ink chamber is connected to each pressure chamber to supply ink to the pressure chamber. The ink-jet head further comprises a wall provided between the second flat face and a wall surface of the common ink chamber. The wall comprises a bottom at a distance not less than a predetermined distance from the second flat face, and a reinforcement portion at a distance more than the predetermined distance from the second flat face.

8 Claims, 22 Drawing Sheets

INK-JET HEAD AND INK-JET PRINTER

BACKGROUND OF THE INVENTION

1. Field of the Invention

The present invention relates to an ink-jet head for forming an image on a print surface by ejecting droplets of ink. The present invention also relates to an ink-jet printer including an ink-jet head.

2. Description of the Related Art

An ink-jet head and an ink-jet printer including the ink-jet head are known in which pressure chambers are arranged along one flat face of a flat passage unit, and each pressure chamber is connected to a nozzle open in the other flat face of the flat passage unit, nozzle open face, and to a common ink chamber, manifold passage, disposed within the passage unit (see U.S. Patent Application No. 2001/0020968). In such an ink-jet head, in general, an actuator unit is bonded to the passage unit to cover the open face of each pressure chamber. The actuator unit includes a piezoelectric element. By the piezoelectric effect obtained by the piezoelectric element, the volume of each pressure chamber is changed to eject ink through the corresponding nozzle.

In the above-described ink-jet head, the common ink chamber provided within the passage unit preferably has a cross section, perpendicular to the ink flow, as large as possible in order that each pressure chamber is smoothly and evenly supplied with ink and thereby a good ejection performance is obtained. On the other hand, in the passage unit and the ink-jet head including the passage unit, reduction in size and a highly dense arrangement of nozzles are required. Therefore, if reduction in size of the passage unit and a highly dense arrangement of nozzles are intended to be realized with suppressing a decrease in the cross section of the common ink chamber, the distance from the nozzle open face to the bottom face of the common ink chamber, that is, the thickness of the bottom wall of the common ink chamber, cannot help being decreased.

On the other hand, in the ink-jet printer, for the purpose that ink in each nozzle is prevented from being dried and/or air contained in ink are discharged with the ink, the nozzles of the ink-jet head are covered with a rubber cap when printing is not performed. An annular protrusion, refered to as a "lip", provided on the cap is brought into contact with the nozzle open face of the passage unit with a relatively large force to isolate the nozzles from the outside air. Therefore, if the distance from the nozzle open face to the bottom face of the common ink chamber is small, that is, the bottom wall of the common ink chamber is thin, the bottom wall of the common ink chamber may be concaved by the capping force applied from the cap to the passage unit.

To prevent this, the profile of the lip may be designed such that the lip to surround the nozzles is not brought into contact with the bottom wall of the common ink chamber in the nozzle open face. In this design, even if the lip strongly presses the passage unit, the bottom wall of the common ink chamber is scarcely influenced by the capping pressure and less likely to be deformed.

The position of the lip to be in contact with the passage unit may deviate from the designed position because of a positional error in assembling the printer. For this reason, a certain distance is necessary between the inner edge of the lip and the periphery of the nozzles. However, if the distance between the inner edge of the lip and the periphery of the nozzles is too large, the outer edge of the lip is close to the bottom wall of the common ink chamber. Hence, even if a slight positional shift occurs, the lip may press the bottom wall of the common ink chamber. To prevent this, the distance between the common ink chamber and the nozzles in a plan view must be increased. In this measure, however, the external shape of the ink-jet head increases in size.

SUMMARY OF THE INVENTION

An object of the present invention is to provide a small-sized ink-jet head capable of suppressing the deformation of a passage unit due to a capping force with ensuring a cross-sectional area of a common ink chamber necessary for obtaining a good ejection performance.

Another object of the present invention is to provide an ink-jet printer capable of suppressing the deformation of a passage unit due to a capping force and reducing the size of an ink-jet head with ensuring a cross-sectional area of a common ink chamber necessary for obtaining a good ejection performance.

According to an aspect of the present invention, an ink-jet head comprises pressure chambers arranged along a first flat face and nozzles each open in a second flat face opposing to the first flat face. The nozzles are connected to the respective pressure chambers. The ink-jet head further comprises a common ink chamber extending along an arrangement of the nozzles. The common ink chamber is connected to each pressure chamber to supply ink to the pressure chamber. The ink-jet head further comprises a wall provided between the second flat face and a wall surface of the common ink chamber. The wall comprises a bottom at a distance not less than a predetermined distance from the second flat face, and a reinforcement portion at a distance more than the predetermined distance from the second flat face.

According to the invention, the reinforcement portion is provided on the wall of the common ink chamber opposite to the second flat face of the passage unit. This improves the strength of the passage unit against capping force applied to the passage unit by a lip when the lip is brought into contact with a nozzle open face of the passage unit. Therefore, reduction in size of the passage unit can be realized with ensuring a cross-sectional area of the common ink chamber necessary for obtaining good ejection performance.

That is, not simply the thickness of the wall of the common ink chamber opposite to the second flat face of the passage unit is increased but part of the wall is left thin and the thickness of only the remaining part of the wall is increased by the reinforcement portion. Thereby, an increase in strength and ensuring a necessary cross-sectional area are compatible. Thus, an ink-jet head can be obtained that is less deformable even when capping force is applied and superior in ejection performance.

According to another aspect of the present invention, an ink-jet head comprises pressure chambers arranged along a first flat face and nozzles each open in a second flat face opposing to the first flat face. The nozzles are connected to the respective pressure chambers. The ink-jet head further comprises a-common ink chamber extending along an arrangement of the nozzles. The common ink chamber is connected to each pressure chamber to supply ink to the pressure chamber. The ink-jet head further comprises a wall provided between the second flat face and a wall surface of the common ink chamber, The wall surface has a portion not parallel to the second flat face.

According to still another aspect of the present invention, an ink-jet printer comprises a flat passage unit. The passage unit comprises pressure chambers arranged along a first flat face of the passage unit, and nozzles each open in a second flat face of the passage unit opposite to the first flat face. The nozzles are connected to the respective pressure chambers. The passage unit further comprises a common ink chamber extending substantially along an arrangement of the nozzles. The common ink chamber is connected to each pressure chamber to supply ink to the pressure chamber. The ink-jet printer further comprises an actuator unit for applying ejection pressure to ink in each pressure chamber, and a cap including an annular lip to be in contact with the second flat face of the passage unit when printing is not performed. At least part of the lip opposite to the common ink chamber is zigzag-shaped in a plane parallel to the second flat face.

According to the invention, the pressure applied to the passage unit by a lip when the lip is brought into contact with a nozzle open face of the passage unit can be lowered. Therefore, even when an ink-jet head in which such a stepped portion as described above is not provided is used, the ink-jet head can be reduced in size with suppressing deformation of the passage unit due to capping force.

According to still another aspect of the present invention, an ink-jet printer comprises a flat passage unit. The passage unit comprises pressure chambers arranged along a first flat face of the passage unit, and nozzles each open in a second flat face of the passage unit opposite to the first flat face. The nozzles are connected to the respective pressure chambers. The passage unit further comprises a common ink chamber extending substantially along an arrangement of the nozzles. The common ink chamber is connected to each pressure chamber to supply ink to the pressure chamber. The ink-jet printer further comprises an actuator unit for applying ejection pressure to ink in each pressure chamber, and a cap including an annular lip to be in contact with the second flat face of the passage unit when printing is not performed. A portion of the lip opposite to the common ink chamber has a part not parallel to the common ink chamber.

According to still another aspect of the present invention, an ink-jet printer comprises a flat passage unit. The passage unit comprises pressure chambers arranged along a first flat face of the passage unit, and nozzles each open in a second flat face of the passage unit opposite to the first flat face. The nozzles are connected to the respective pressure chambers. The passage unit further comprises a common ink chamber extending substantially along an arrangement of the nozzles. The common ink chamber is connected to each pressure chamber to supply ink to the pressure chamber. The ink-jet printer further comprises an actuator unit for applying ejection pressure to ink in each pressure chamber and a cap including an annular lip to be in contact with the second flat face of the passage unit when printing is not performed. A width of a portion of the lip opposite to the common ink chamber is larger than a width of a portion of the lip not opposite to the common ink chamber.

According to still another aspect of the present invention, an ink-jet printer comprises a flat passage unit. The passage unit comprises pressure chambers arranged along a first flat face of the passage unit, and nozzles each open in a second flat face of the passage unit opposite to the first flat face. The nozzles are connected to the respective pressure chambers. The passage unit further comprises a common ink chamber extending substantially along an arrangement of the nozzles. The common ink chamber is connected to each pressure chamber to supply ink to the pressure chamber. The ink-jet printer further comprises an actuator unit for applying ejection pressure to ink in each pressure chamber and a cap including an annular rectangular lip to be in contact with the second flat face of the passage unit when printing is not performed. A width of a portion of the lip along a length of the common ink chamber is larger than a width of a portion of the lip substantially perpendicular to the length of the common ink chamber.

BRIEF DESCRIPTION OF THE DRAWINGS

Various exemplary embodiments of the invention will be described in detail with reference to the following figures, wherein.

DESCRIPTION OF THE PREFERRED EMBODIMENTS

Figure 1:
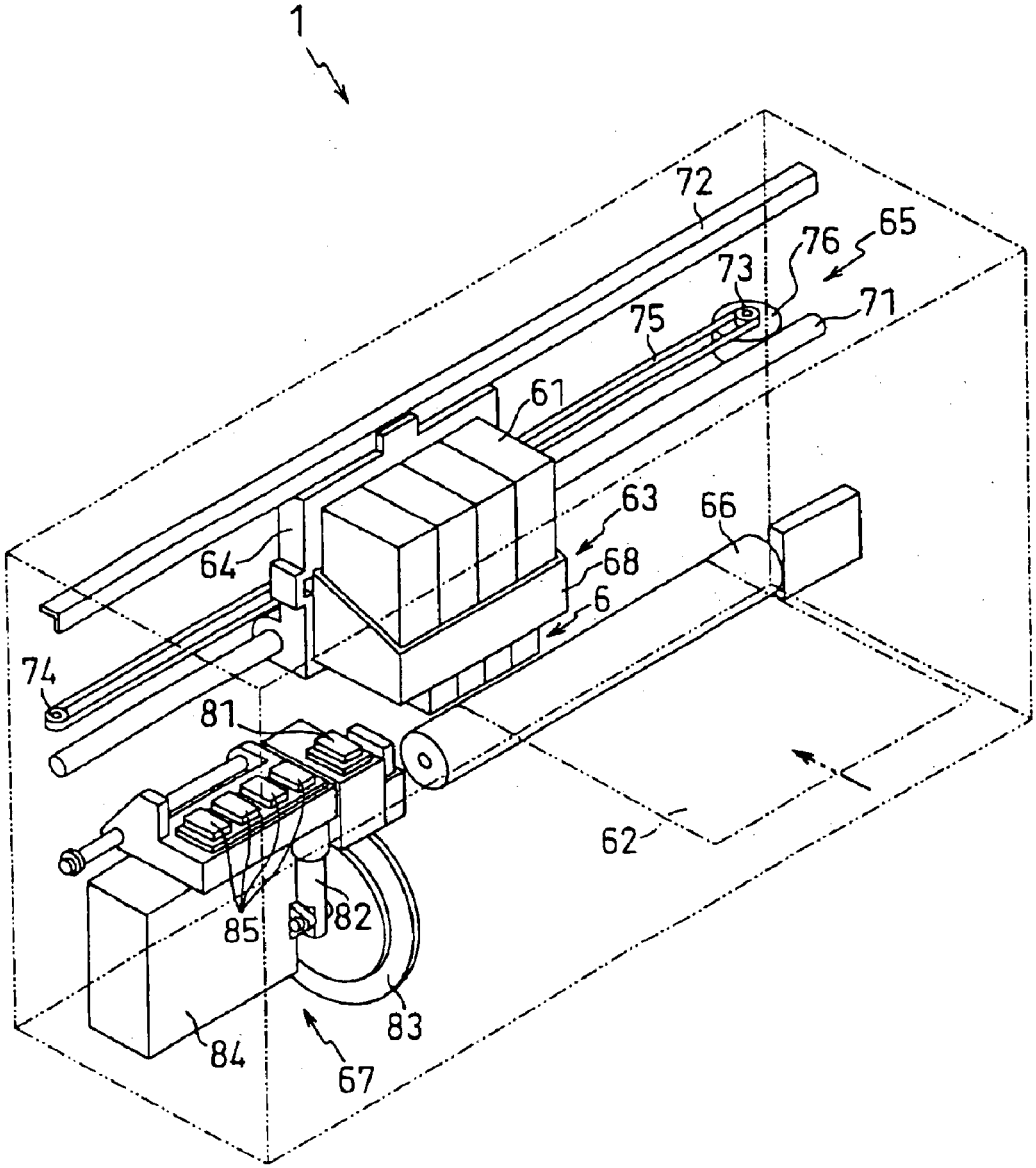
FIG. 1 is a perspective view of a color ink-jet printer including ink-jet heads according to a first embodiment of the present invention.

FIG. 1 is a perspective view illustrating a general construction of a color ink-jet printer including ink-jet heads according to a first embodiment of the present invention. As illustrated in FIG. 1, in a head assembly 63 of the color ink-jet printer 1, four piezoelectric ink-jet heads 6 are fixed to a main frame 68 for ejecting four color inks (for example, cyan, magenta, yellow, and black), respectively. Further, four ink cartridges 61 filled with the respective color inks are attached to the main frame 68 so as to be detachable. The main frame 68 is fixed to a carriage 64, which is driven by a drive system 65 to be reciprocated along a straight line. A platen roller 66 for transporting a paper is disposed such that the central axis of the platen roller 66 extends along the reciprocation of the carriage 64. The platen roller 66 is opposed to the ink-jet heads 6.

The carriage 64 is supported by a guide shaft 71 and a guide plate 72, which are disposed parallel to the axis of the platen roller 66, such that the carriage 64 can freely slide along the guide shaft 71 and the guide plate 72. Pulleys 73 and 74 are disposed near both ends of the guide shaft 71. An endless belt 75 is stretched between the pulleys 73 and 74. The carriage 64 is fixed to the endless belt 75. In this construction of the drive system 65, when the pulley 73 is driven by an electric motor 76 to be rotated clockwise and counterclockwise, the carriage 64 is linearly reciprocated along the guide shaft 71 and the guide plate 72 accordingly. Thereby, the head assembly 63 is reciprocated.

A paper 62 is fed from a feed cassette (not illustrated) provided on one side of the ink-jet printer 1. The paper 62 is then introduced between the ink-jet heads 6 and the platen roller 66. After printing is performed with inks ejected from the respective ink-jet heads 6, the paper 62 is discharged from the ink-jet printer 1. In FIG. 1, illustration of the paper feed system and the paper discharge system is omitted.

A purge system 67 forcibly sucks and discharges bad ink containing air and dust having accumulated inside each ink-jet head 6. The purge system 67 is disposed on one side of the platen roller 66. The position of the purge system 67 is determined such that the purge system 67 can be opposed to the ink-jet heads 6 when the head assembly 63 is moved to a reset position by the drive system 65.

Figure 2:
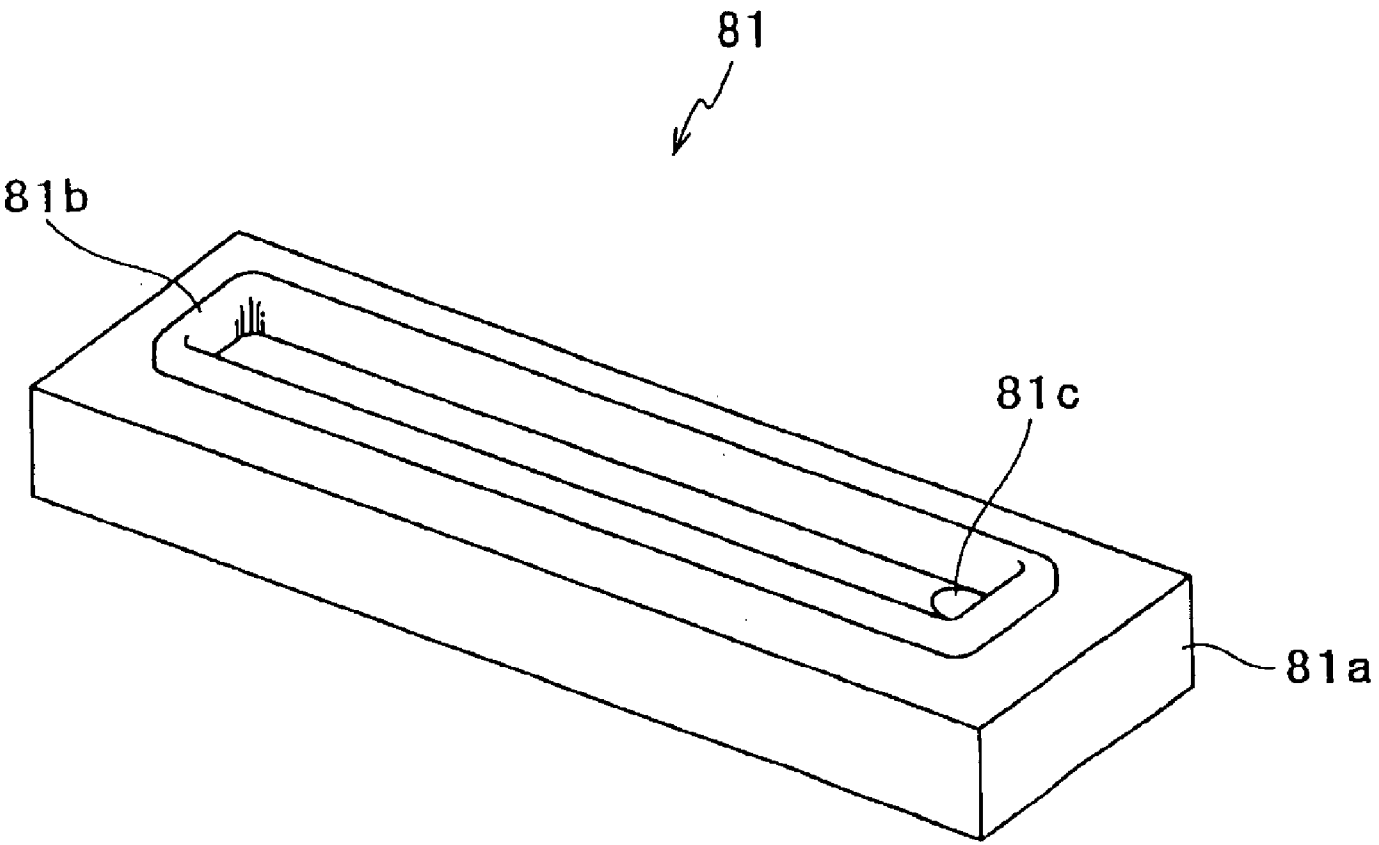
FIG. 2 is a perspective view of a purge cap included in the printer of FIG. 1.

The purge system 67 includes a purge cap 81 made of rubber. FIG. 2 illustrates an enlarged perspective view of the purge cap 81. The purge cap 81 is made up of a substantially rectangular parallelepiped main body 81*a* and an annular lip 81*b* protruding from the upper face of the main body 81*a*. The lip 81*b* has an elongated circular shape for surrounding nozzle rows as described later. In the purge cap 81, a hole 81*c* connected to a pump, which will be described later, is formed in the upper face of the main body 81*a* within the area surrounded by the lip 81*b*.

When purging, one of the four ink-jet heads 6 is moved with the carriage 64 to be opposed to the purge cap 81. A cam 83 is then driven by a non-illustrated drive source to move the purge cap 81 up. Thereby, the lip 81*b* of the purge cap 81 is brought into contact with the lower face 10*a* of the ink-jet head 6 (the nozzle open face, i.e., ink ejection face) (see FIG. 7) so that the lip 81*b* surrounds the nozzles of the head. Bad ink containing air collected inside the ink-jet head 6 is then sucked by a pump 82 driven through the cam 82. The sucked bad ink is discharged into a waste ink reservoir 84. Thus, the ink-jet head 6 is refreshed. Thereby, air can be removed when the ink-jet head 6 is initially supplied with ink, or the ink-jet head 6 can be restored to its normal condition from a bad ejection condition caused by inside air growth upon printing.

Four caps 85 illustrated in FIG. 1 are to cover the nozzles of the respective ink-jet heads 6 on the carriage 64 returned to the reset position after printing is completed. Each ink passage is thereby prevented from clogging by separation of a solid component of ink because of evaporation of its liquid component. Like the purge cap 81 of FIG. 2, each cap 85 is also made up of a rectangular parallelepiped main body and an elongated circular-shaped lip protruding from the upper face of the main body (though a hole 81*c* as in the purge cap 81 is not provided in the cap 85). When printing is not performed, each cap 85 is moved up by non-illustrated cam means in linkage with movement of the carriage 64 and the lip of each cap 85 is brought into contact with the nozzle open face 10*a* of the corresponding ink-jet head 6 to seal the nozzles of each ink-jet head 6.

Figure 3:
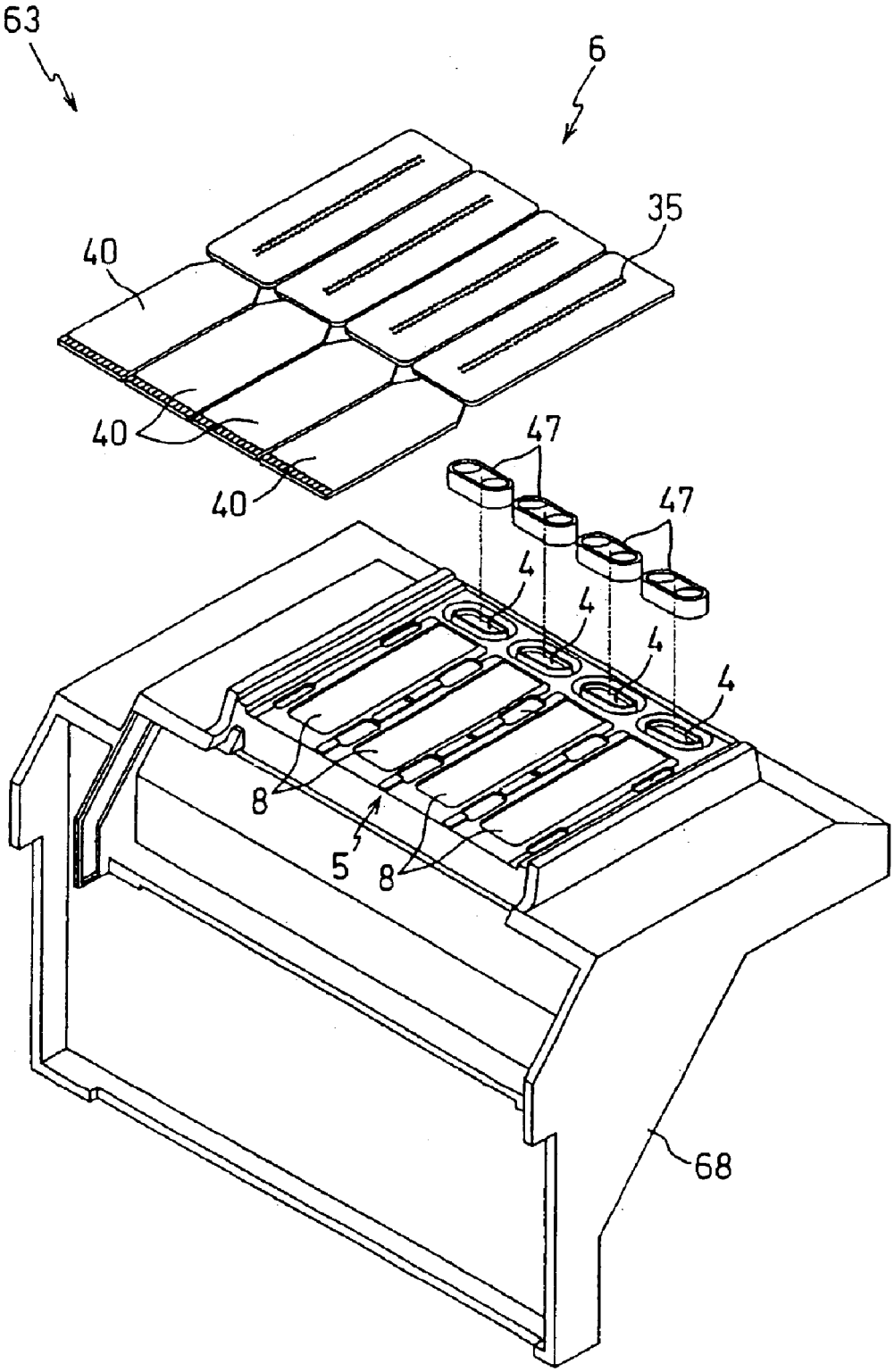
FIG. 3 is a perspective view of a head assembly included in the printer of FIG. 1.

FIG. 3 illustrates a perspective view in a state that the head assembly 63 is vertically inverted. The main frame 68 of the head assembly 63 is nearly box-shaped, the upper face of which (illustrated as the lower face in FIG. 3) is open on the open side, four mount portions are provided on which the respective ink cartridges 61 can be mounted so as to be detachable.

Referring to FIG. 3, four ink supply passages 4 are provided near one ends of the respective mount portions of the main frame 68. Each ink supply passage 4 can be connected to an ink outlet port of the corresponding ink cartridge 61. Each ink supply passage 4 is open in the lower face of a bottom plate 5 of the main frame 68 (the face to which each ink-jet head 6 is fixed). Joints 47 each made of rubber or the like are attached to the lower face of the bottom plate 5 to correspond to the respective ink supply passages 4. Each joint 47 can be brought into close contact with an ink supply port 39 of the corresponding ink-jet head 6 (see FIG. 4).

In the lower face of the bottom plate 5, four recesses 8 are formed for receiving the four ink-jet heads 6 in parallel. Each ink-jet head 6 fitted in the corresponding recess 8 is fixed to the recess 8 with an ultraviolet-setting adhesive. Although not illustrated, the four ink-jet heads 6 fixed in the recesses 8 are protected by a protective cover attached to the main frame 68. Four elliptic openings are provided in the protective cover for exposing the nozzles of the respective ink-jet heads 6.

Figure 4:
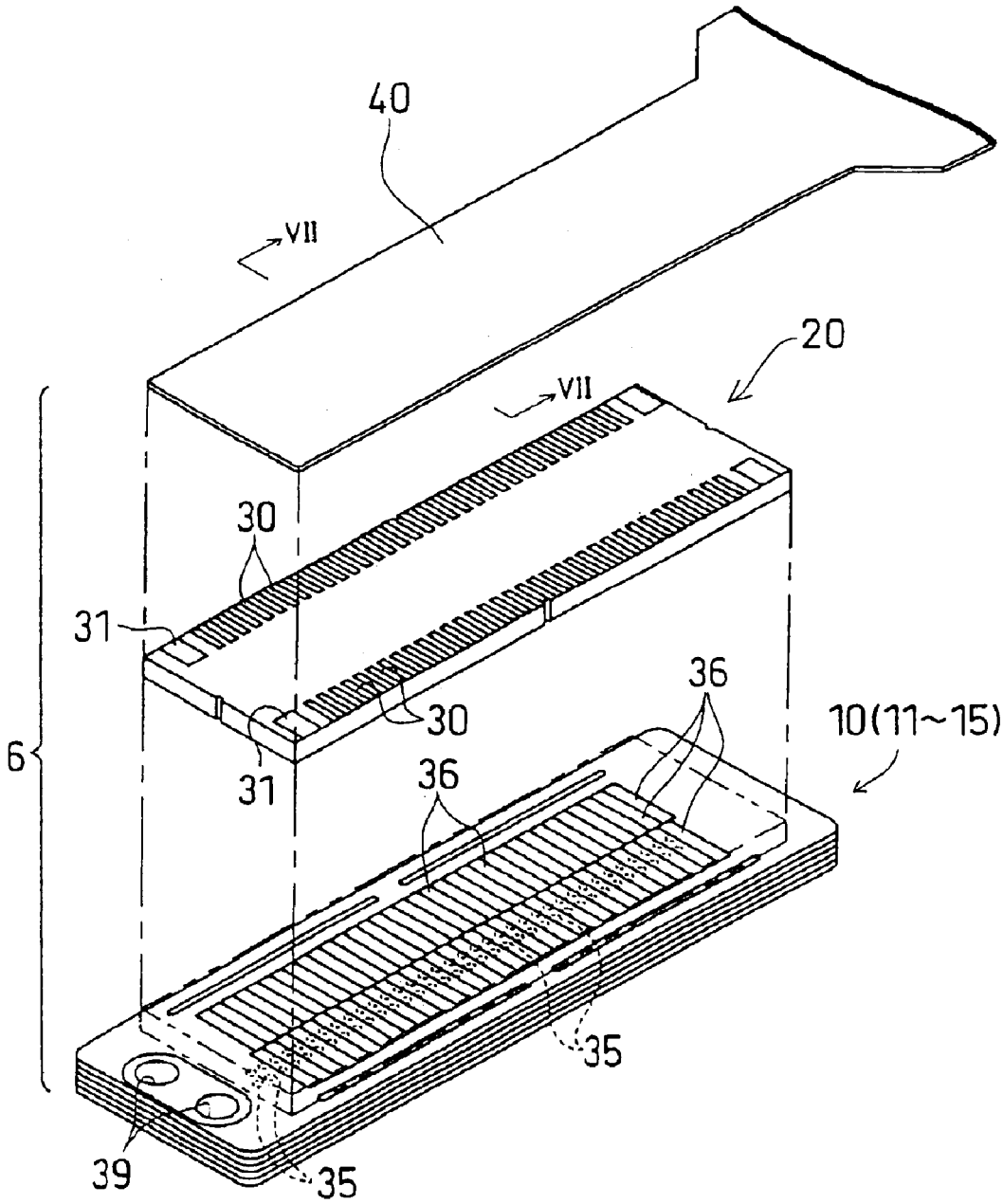
FIG. 4 is an exploded perspective view of an ink-jet head included in the head assembly of FIG. 3.

FIG. 4 illustrates a perspective view of an ink-jet head 6 according to this embodiment. The ink-jet head 6 includes a laminated passage unit 10. A plate-type piezoelectric actuator, hereinafter referred to as actuator unit, 20 is put on and bonded to the passage unit 10 with an adhesive or an adhesive sheet. A flexible flat cable 40 for electrical connection to a driver IC is bonded to the upper face of the actuator unit 20 with an adhesive. The cable 40 is electrically connected to the actuator unit 20. A large number of nozzles 35 are open in the lower face of the passage unit 10. Ink is ejected downward through each nozzle 35.

Figure 5:
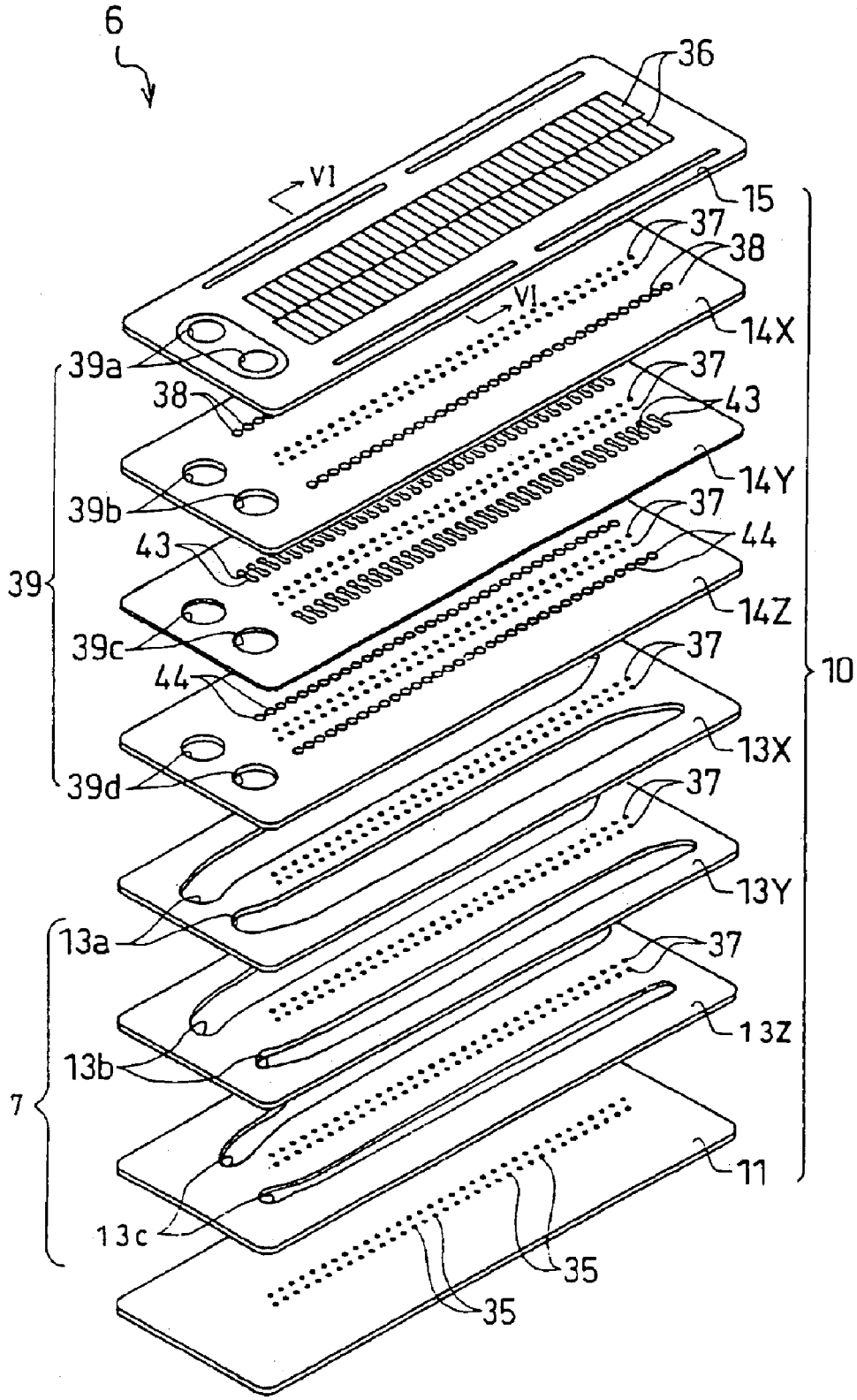
FIG. 5 is an exploded perspective view of a passage unit in the ink-jet head of FIG. 4.
Figure 6:
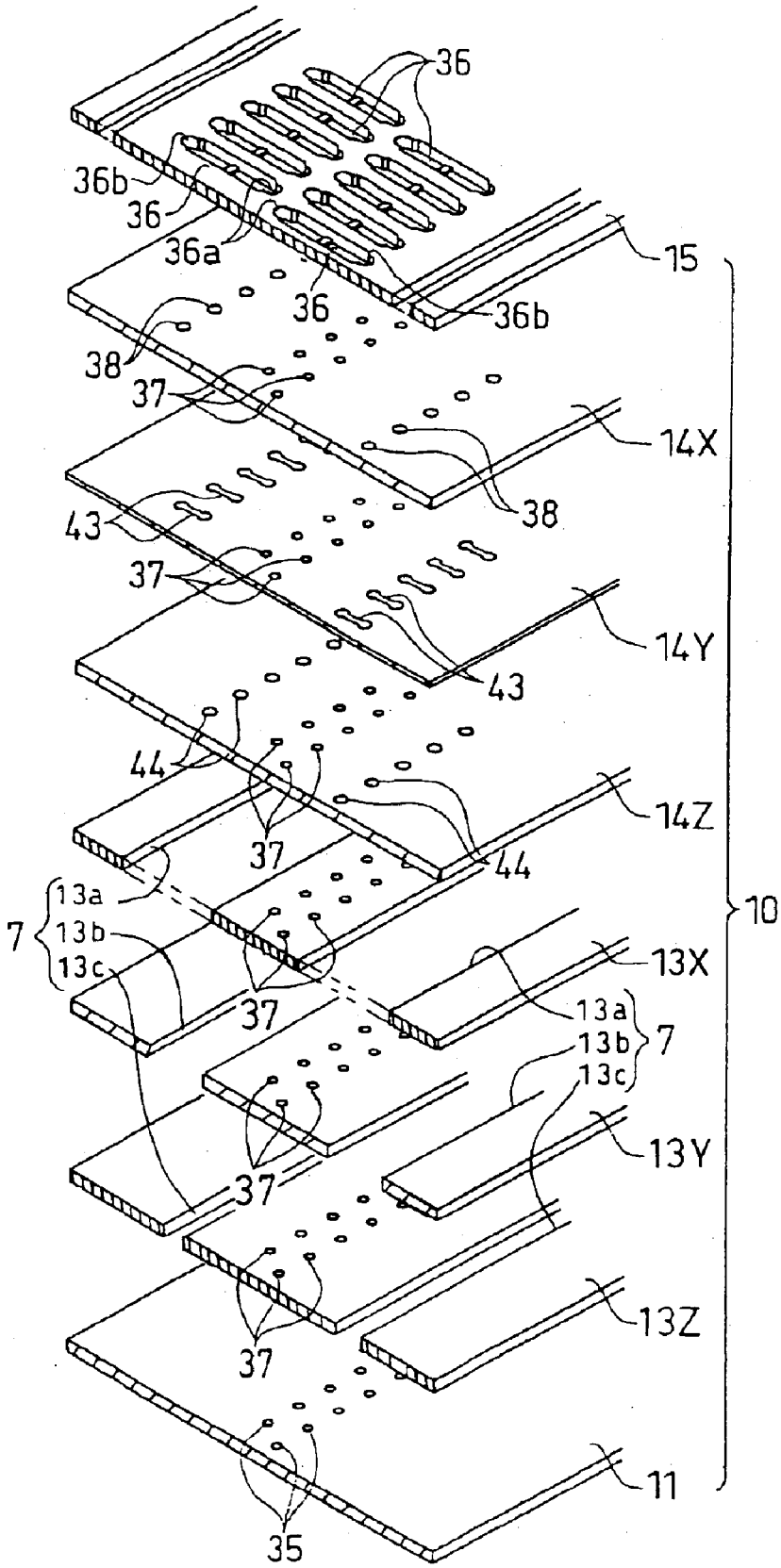
FIG. 6 is an enlarged exploded perspective view of the passage unit of FIG. 5.

FIG. 5 illustrates an exploded perspective view of the passage unit 10. FIG. 6 illustrates an enlarged exploded perspective view of the passage unit 10 (a sectional view taken along line VI—VI in FIG. 5). As illustrated in FIGS. 5 and 6, the passage unit 10 is made up of eight thin plates, i.e., a nozzle plate 11, three manifold plates 13X, 13Y, and 13Z, three spacer plates 14X, 14Y, and 14Z, and a base plate 15. These eight plates are put in layers and bonded to each other with an adhesive. The nozzle plate 11 is made of a polyimide-base material. The other plates are made of stainless steel or 42%-nickel alloy (42 alloy). Each of the plates 11 to 14 has a thickness of about 50 to 150 microns.

As illustrated in FIGS. 5 and 6, a large number of nozzles 35 each having a small diameter (for example, about 25 microns) for ejecting ink are formed in the nozzle plate 11 by pressing or laser processing. The nozzles 35 are arranged at small intervals in two rows in a zigzag manner along the length of the nozzle plate 11. The lower face of the nozzle plate 11 is the nozzle open face 10*a* (see FIG. 7).

As illustrated in FIG. 6, a large number of pressure chambers 36 are formed in the base plate 15 in two rows in a zigzag arrangement along the length of the base plate 15. Each pressure chamber 36 is made into a slender shape the length of which is perpendicular to the length of the base plate 15.

Figure 7:
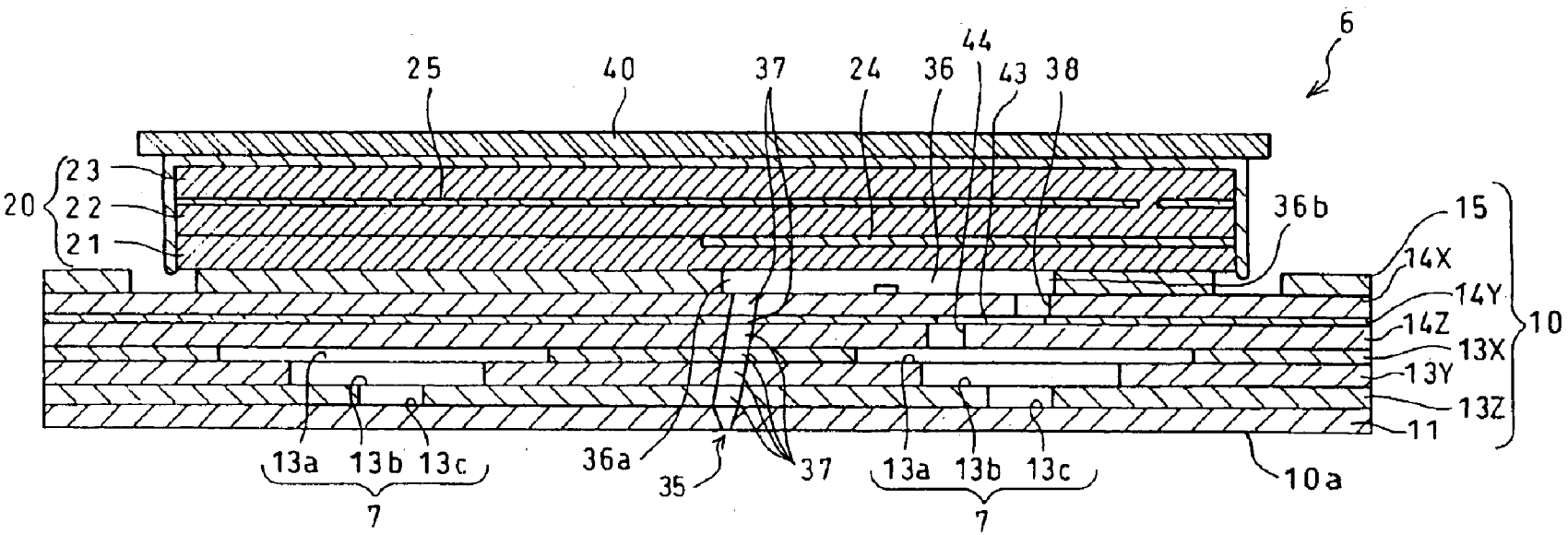
FIG. 7 is an enlarged sectional view taken along line VII—VII in FIG. 4.

As illustrated in FIG. 7, which is an enlarged sectional view taken along line VII—VII in FIG. 4, one end portion 36*a* of each pressure chamber 36 formed in the base plate 15 is connected to a nozzle 35 formed in the nozzle plate 11, through a small-diameter through-hole 37 formed in the three spacer plates 14X, 14Y, and 14Z and the three manifold plates 13X, 13Y, and 13Z. Such through-holes 37 are arranged in a zigzag manner like the pressure chambers and the nozzles. In FIG. 7, the entire lower face of the flexible flat cable 40 is bonded to the actuator unit 20. In fact, however, the flexible flat cable 40 may be electrically connected to the actuator unit 20 at necessary portions and separated from the actuator unit 20 at the other portions.

Ink supply holes 38 are formed in the uppermost spacer plate 14X neighboring the base plate 15 to correspond to the respective pressure chambers 36. Each ink supply hole 38 is connected to the other end portion 36*b* of the corresponding pressure chamber 36. Throttle portions 43 are formed through the thickness of the middle spacer plate 14Y immediately below the uppermost spacer plate 14X. Each aperture 43 has a slender shape in the plane of the middle spacer plate 14Y (more specifically, in parallel with the length of each pressure Chamber 36). Each ink supply hole 38 is connected to one end of the corresponding aperture. The other end of each aperture 43 is connected to a common ink chamber 7, which will be described later, through an induction hole 44 formed in the lowermost spacer plate 14Z. In the ink-jet head 6 according to this embodiment, the sectional area of the flow passage in each aperture is set to a proper value. Thereby, the throttle effect suppresses propagation of pressure variation in ink, which is caused by an operation of the actuator unit 20 as described later, toward the corresponding ink supply hole 38. Thus, good ink ejection through each nozzle 35 is realized.

As illustrated in FIG. 6, in the uppermost manifold plate 13X that is the closest one of the three manifold plates 13X, 13Y, and 13Z to the spacer plates 14X to 14Z, two ink chamber upper portions 13*a* are formed through the thickness of the uppermost manifold plate 13X. The two ink chamber upper portions 13*a* are disposed on both sides of two rows of the through-holes 37. Each ink chamber upper portion 13*a* has a slender shape along the length of the passage unit 10. In the middle manifold plate 13Y on the lower side of the uppermost manifold plate 13X, two ink chamber middle portions 13*b* are formed through the thickness of the middle manifold plate 13Y. Each ink chamber middle portion 13*b* has a slender shape along the length of the passage unit 10. In plane, each ink chamber middle portion 13*b* is included within the corresponding ink chamber upper portion 13*a*, that is, the ink chamber middle portion 13*b* is narrower than the ink chamber upper portion 13*a*. Further, in the lowermost manifold plate 13Z on the lower side of the middle manifold plate 13Y, two ink chamber lower portions 13*c* are formed through the thickness of the lowermost manifold plate 13Z. Each ink chamber lower portion 13*c* has a slender shape along the length of the passage unit 10. In plane, each ink chamber lower portion 13*c* is included within the corresponding ink chamber middle portion 13*b*, that is, the ink chamber lower portion 13*c* is narrower than the ink chamber middle portion 13*b*. In this embodiment, the ink chamber upper, middle, and lower portions 13*a*, 13*b*, and 13*c* are formed by etching.

When the three manifold plates 13X, 13Y, and 13Z are put in layers, the vertically corresponding ink chamber upper, middle, and lower portions 13*a*, 13*b*, and 13*c* are connected to each other. Thus, two common ink chambers 7 are formed on both sides of two rows of the through-holes 37, as illustrated in FIG. 7. The upper face of each common ink chamber 7 is closed with the spacer plate 14Z. The lower face of each common ink chamber 7 is closed with the nozzle plate 11. In the vicinity of the end of each common ink chamber 7 farther from the corresponding ink supply port 39*a*, the sectional area of the common ink chamber 7 along the width of the passage unit 10 reduces at a certain rate as the distance from the ink supply port 39*a* increases. This is because residual bubbles, which are apt to stay in the vicinity of the end of each common ink chamber 7, are made easy to be discharged.

Figure 8:
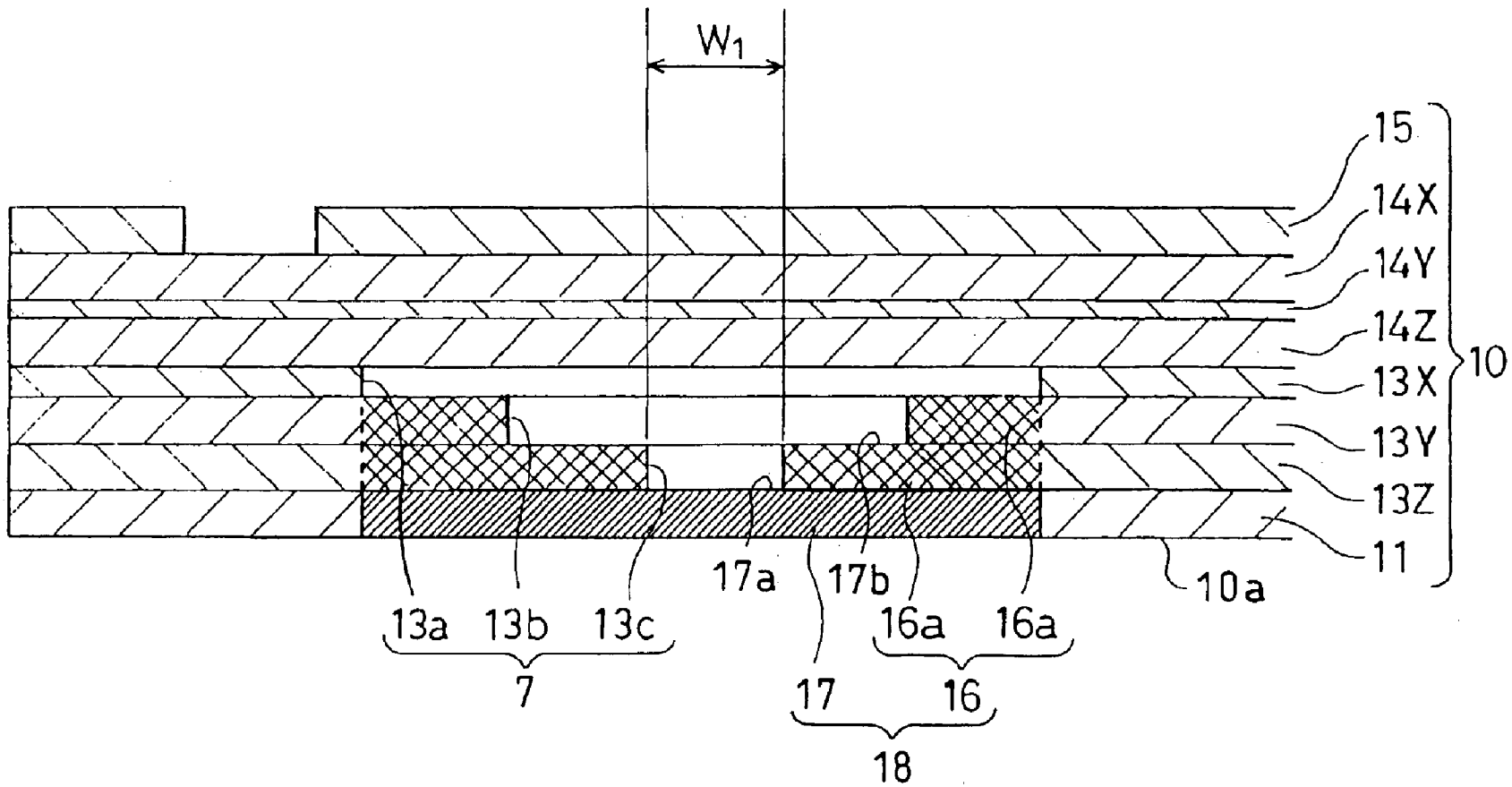
FIG. 8 is an enlarged sectional view of the passage unit of FIG. 7 in the vicinity of a common ink chamber.

FIG. 8 illustrates an enlarged sectional view of the passage unit in the vicinity of a common ink chamber. In FIG. 8, illustration of the actuator unit 20 is omitted. As apparent from FIG. 8, a bottom wall 18 formed between the nozzle open face 10*a* and a wall surface 17*b* of the common ink chamber 17 has a cross section of a stepped shape, in which a bottom face 17*a* central in plane (in this embodiment, the bottom face of the ink chamber lower portion 13*c*) is the closest to the nozzle open face 10*a* and two steps are formed on both sides of the bottom face 17*a*. More specifically, the bottom wall 18 includes a bottom portion 17 and a reinforcement portion 16. The bottom portion 17 is in a region of the nozzle plate 11 corresponding to the ink chamber upper portion 13*a*. The reinforcement portion 16 (illustrated with cross-hatching in FIG. 8) is made up of a portion 16*a* of the manifold plate 13Y protruding inward beyond the inner wall of the manifold plate 13X and a portion 16*b* of the manifold plate 13Z protruding inward beyond the inner wall of the manifold plate 13X. Because of the presence of the reinforcement portion 16, the width $W_1$ of the bottom face 17*a* of the common ink chamber 17 (the portion of the upper face of the bottom portion 17 not covered with the reinforcement portion 16) is smaller than the width of the ink chamber upper portion 13*a* where the reinforcement portion is not present, by the length of the protrusion of the reinforcement portion 16 from the inner wall of the manifold plate 13X. In this embodiment, the bottom face 17*a* extends substantially straight along the length of the passage unit 10.

In this embodiment, two common ink chambers 7 are provided on both sides of the rows of the through-holes 37 so as to correspond to two rows of pressure chambers 36, respectively. That is, the pressure chambers 36 in one row are connected to one common ink chamber 7 while the pressure chambers 36 in the other row are connected to the other common ink chamber 7. Because the ink-jet head 6 is thus constructed, if the two common ink chambers 7 are supplied with inks different in color, printing in two colors can be performed with the single ink-jet head 6. This improves the applicability of the ink-jet head 6 and makes it possible to reduce the number of kinds of parts of the ink-jet head 6. In this embodiment, however, both the common ink chambers 7 are supplied with the same color ink to perform printing in monochrome at a high resolution with two rows of nozzles 35.

Referring back to FIG. 5, two ink supply holes 39*a* are formed in the base plate 15. Also, two ink supply holes 39*b*, two ink supply holes 39*c*, and two ink supply holes 39*d* are formed in the spacer plates 14X, 14Y, and 14Z, respectively. When the base plate 15 and the spacer plates 14X, 14Y, and 14Z are put in layers, the corresponding ink supply holes 39*a* to 39*d* are connected to each other to form two ink supply holes 39 corresponding to the respective common ink chamber 7 as described above. From the demand of reduction in size of the ink-jet head 6, each ink supply hole 39 is disposed near the corresponding row of pressure chambers 36 and the two ink supply holes 39 are disposed close to each other.

In the passage unit 10 constructed as described above, ink supplied into a common ink chamber 7 through the corresponding ink supply hole 39 flows to the other end 30*b* of each pressure chamber 36 through the corresponding induction hole 44, aperture 43, and ink supply hole 38. Ink in each pressure chamber 36 to which ejection energy has been applied by the actuator unit 20 as described later flows from the one end 36*a* of the pressure chamber 36 through the corresponding through-hole 37 to the corresponding nozzle 35 and then ejected through the nozzle 35.

Figure 9:
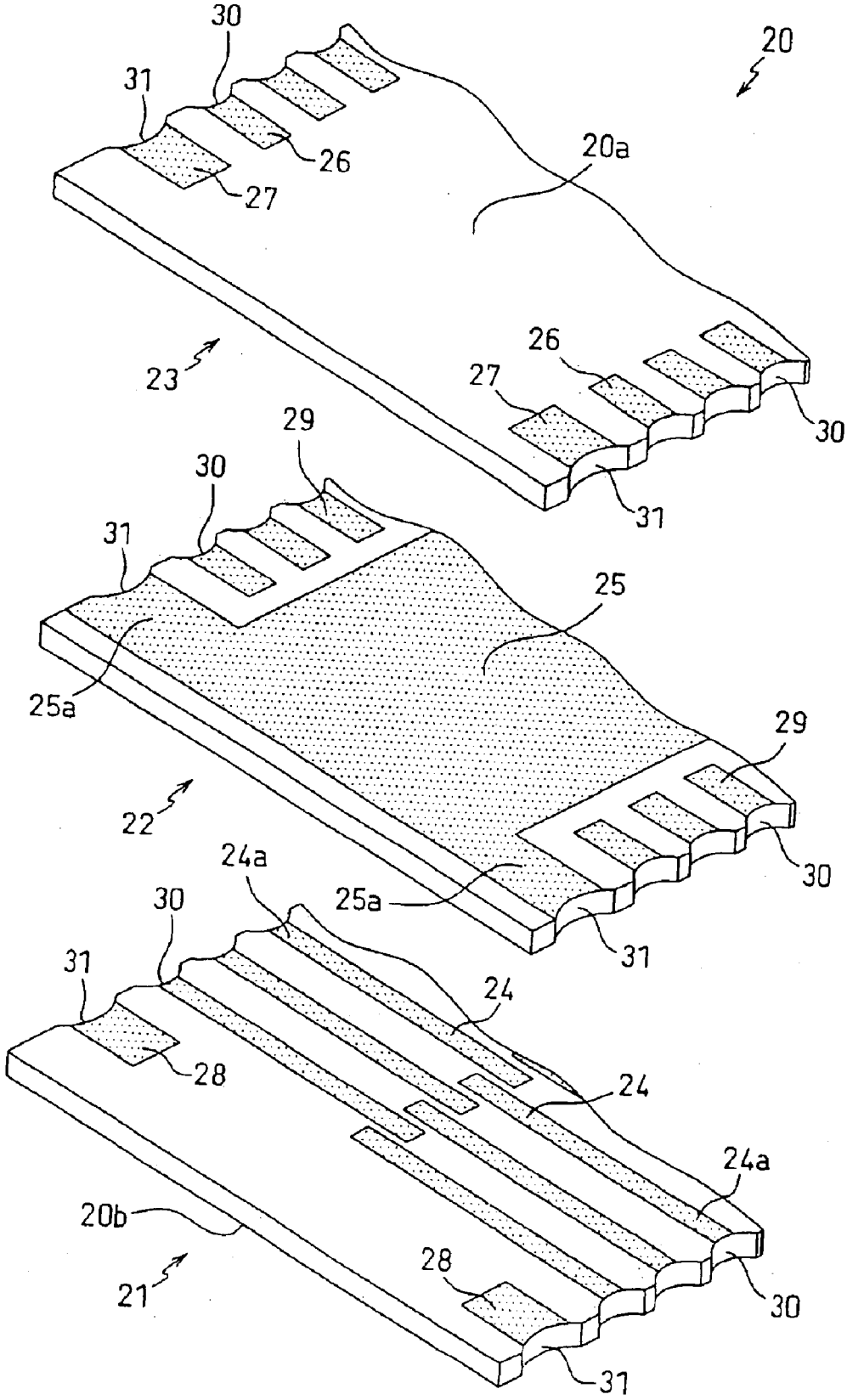
FIG. 9 is an enlarged exploded perspective view of an actuator unit in the ink-jet head of FIG. 4.

Next, the construction of the actuator unit 20 will be described. FIG. 9 illustrates an enlarged exploded perspective view of the actuator unit 20. As illustrated in FIGS. 7 and 9, the actuator unit 20 is laminated with two piezoelectric sheets 21 and 22 and an insulating sheet 23 on the upper face of the piezoelectric sheet 21, slender individual electrodes 24 are provided in a zigzag arrangement to correspond to the respective pressure chambers 36 in the passage unit 10. One end 24*a* of each individual electrode 24 is exposed from the actuator unit 20 in the left or right face of the actuator unit 20 perpendicular to the upper and lower faces 20*a* and 20*b* of the actuator unit 20.

On the upper face of the piezoelectric sheet 22, a common electrode 25 is provided in common to many pressure chambers 36. Like one end 24*a* of each individual electrode 24, ends 25*a* of the common electrode 25 are also exposed from the actuator unit 20 in the left and right faces of the actuator unit 20. Two or more pairs of piezoelectric sheets 21 and 22 may be put in layers. The region of the piezoelectric sheet 22 sandwiched by each individual electrode 24 and the common electrode 25 functions as a pressure generation portion (active portion) for the corresponding pressure chamber 36.

On the upper face of the insulating sheet 23 in the uppermost layer, surface electrodes 26 corresponding to the respective individual electrodes 24 and surface electrodes 27 corresponding to the common electrode 25 are provided with being arranged along the left and right faces of the insulating sheet 23.

In the left and right faces of the actuator unit 20, first concave grooves 30 corresponding to the one ends 24*a* of the respective individual electrodes 24 and second concave grooves 31 corresponding to the ends 25*a* of the common electrode 25 are formed to extend along the lamination of the actuator unit 20. A side electrode (not illustrated) is provided in each first concave groove 30 to electrically connect the corresponding individual and surface electrodes 24 and 26 to each other. Also, a side electrode (not illustrated) is provided in each second concave groove 31 to electrically connect the common and surface electrodes 25 and 27 to each other. Electrodes denoted by references 28 and 29 are dummy-pattern electrodes.

The passage unit 10 and the actuator unit 20 constructed as described above are put in layers such that the pressure chambers 36 in the passage unit 10 correspond to the respective individual electrodes 24 in the actuator unit 20. Further, various patterns (not illustrated) on the flexible flat cable 40 are electrically connected to the surface electrodes 26 and 27 on the upper face 20*a* of the actuator unit 20.

When a voltage is applied between an arbitrarily selected individual electrode 24 and the common electrode 25 of the actuator unit 20, strain is generated along the lamination of the actuator unit 20 by the piezoelectric effect in the portion (active portion) of the piezoelectric sheet 22 corresponding to the individual electrode 24 to which the voltage has been applied. Thereby, the volume of the corresponding pressure chamber 36 reduces. Ejection energy is thus applied to ink in the pressure chamber 36. The ink is then ejected in droplets through the corresponding nozzle 35 to print a predetermined image on the paper 62.

Figure 10:
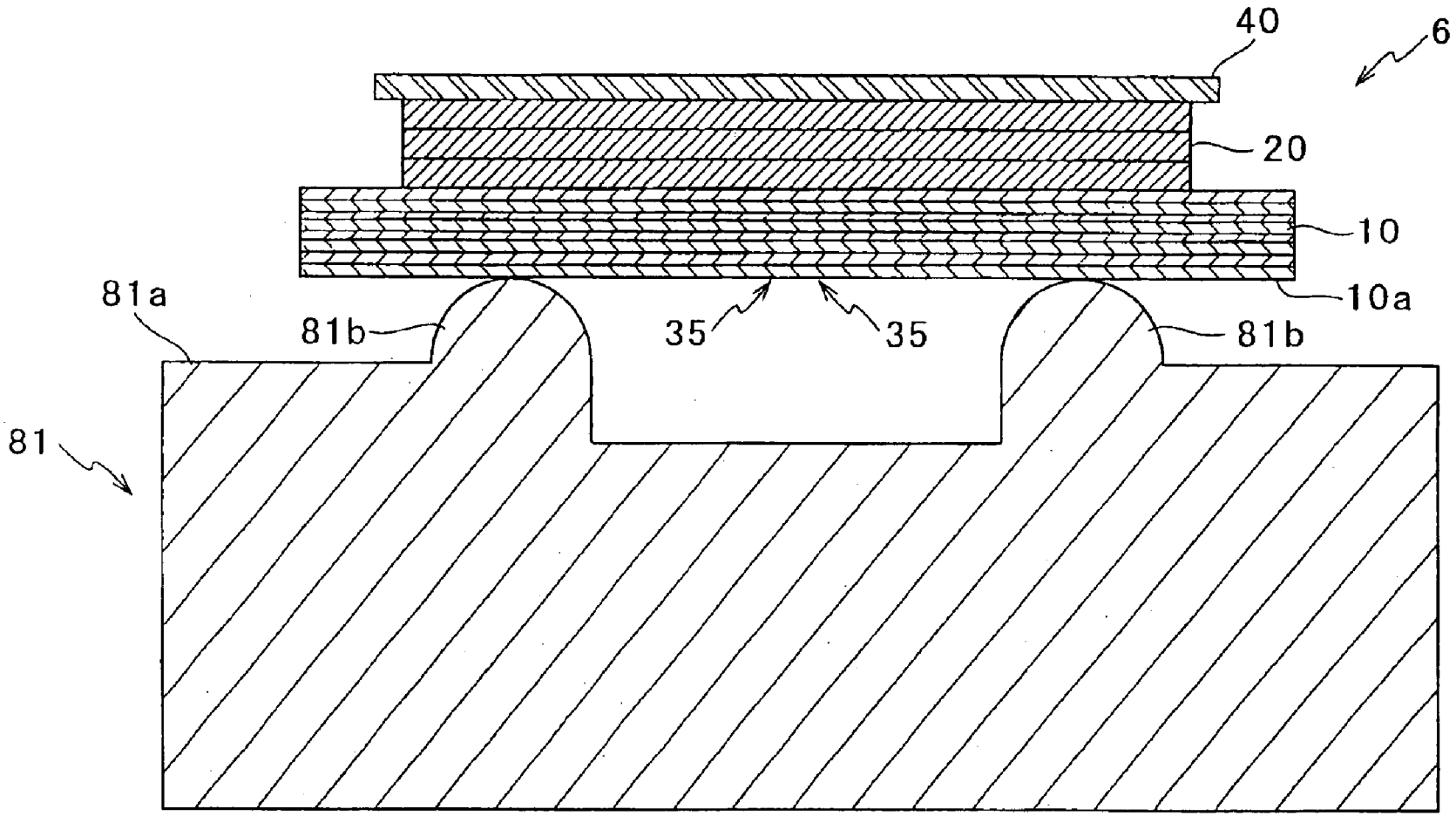
FIG. 10 is a sectional view illustrating a state that nozzles of the ink-jet head are covered with the purge cap.
Figure 11:
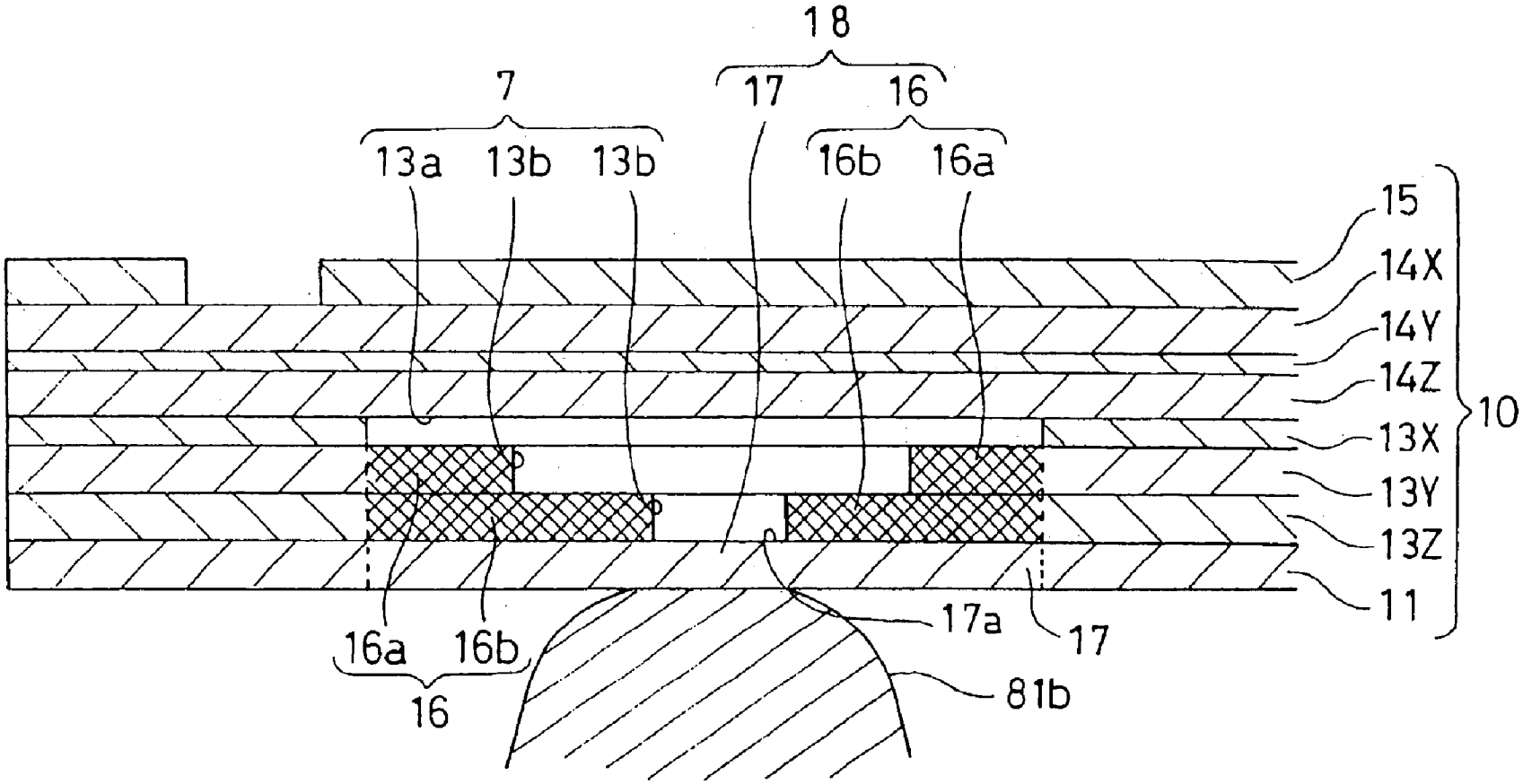
FIG. 11 is an enlarged view of a principal part of FIG. 10.

FIG. 10 is a sectional view illustrating a state that the nozzles of the ink-jet head 6 are covered with the purge cap 81. FIG. 11 is an enlarged view of a principal part of FIG. 10. In FIG. 10, illustration of the detailed construction of the passage unit 10 and the hole 81*c* is omitted.

As illustrated in FIG. 10, the purge cap 81 is in contact with the nozzle open face 10*a* of the ink-jet head 6 with the lip 81*b* surrounding the rows of nozzles 35. At this time, because of the construction of the passage unit 10, in many cases, the lip 81*b* is positioned below each common ink chamber 7 made up of the ink chamber upper, middle, and lower portions 13*a*, 13*b*, and 13*c*, as illustrated in FIG. 11.

In the ink-jet head 6 according to this embodiment, the bottom wall 18 of each common ink chamber 7 includes the reinforcement portion 16 as described above. Therefore, even when the lip 81*b* of the purge cap 81 is in contact with the thinnest portion of the bottom wall 18 of the common ink chamber 7 corresponding to the bottom face 17*a* as illustrated in FIG. 11, because the bottom wall 18 increases step-like in vertical thickness on both sides of the contact portion, the capping force by pressing is dispersed to the stepped reinforcement portion 16. As a result, the portion of the nozzle plate 11 corresponding to the common ink chamber 7 is scarcely deformed. In this embodiment, the length of the protrusion of the reinforcement portion 16 is preferably determined such that the width of the bottom wall 17*a* is smaller than the width of the tip end of the lip 81*b*. In this measure, the strength at the bottom face 17*a* against the capping force is remarkably improved, so the printer need not be designed so that the lip 81*b* may not be in contact with a portion below the bottom face 17*a*.

Further, in this embodiment, the nozzle plate 11 can be made thin and thereby the bottom face 17*a* of each common ink chamber 7 can be close to the nozzle open face 10*a* to ensure a sufficient volume of each common ink chamber 7. That is, this embodiment can reconcile smooth and even ink supply to each pressure chamber and an increase in strength of the passage unit 10 against capping force.

Particularly in the ink-jet head 6 according to this embodiment, the passage unit 10 is made up of the plural plates 11, 13X, 13Y, 13Z, 14X, 14Y, 14Z, and 15. Therefore, by properly changing the shapes of the manifold plates 13X, 13Y, and 13Z, each common ink chamber 7 can be easily made into the optimum shape. For example, by properly changing the width of each bottom face 17*a* and/or the difference in length between the portions 16*a* and 16*b* of each reinforcement portion 16, the shape of each common ink chamber 7 can be easily determined so as to have sufficient strength against capping force and the necessary minimum cross-sectional area.

In the above, capping force by the purge cap 81 has been discussed by way or example. However, the same can apply to is capping force by each cap 85. Thus, the construction according to this embodiment is effective also to the latter case.

Figure 12:
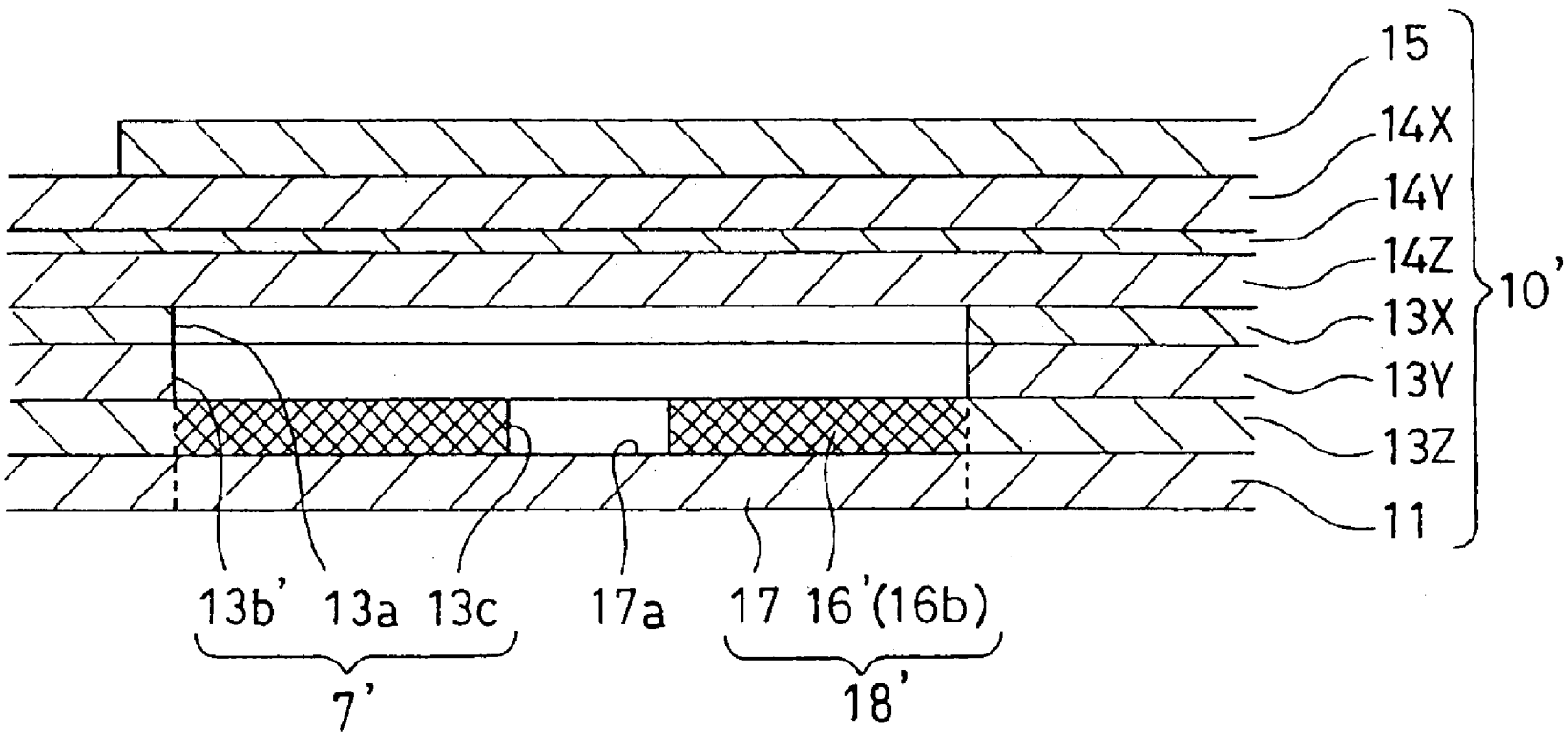
FIG. 12 is an enlarged sectional view of a passage unit in an ink-jet head according to a first modification of the first embodiment of the present inventions corresponding to FIG. 8.
Figure 13:
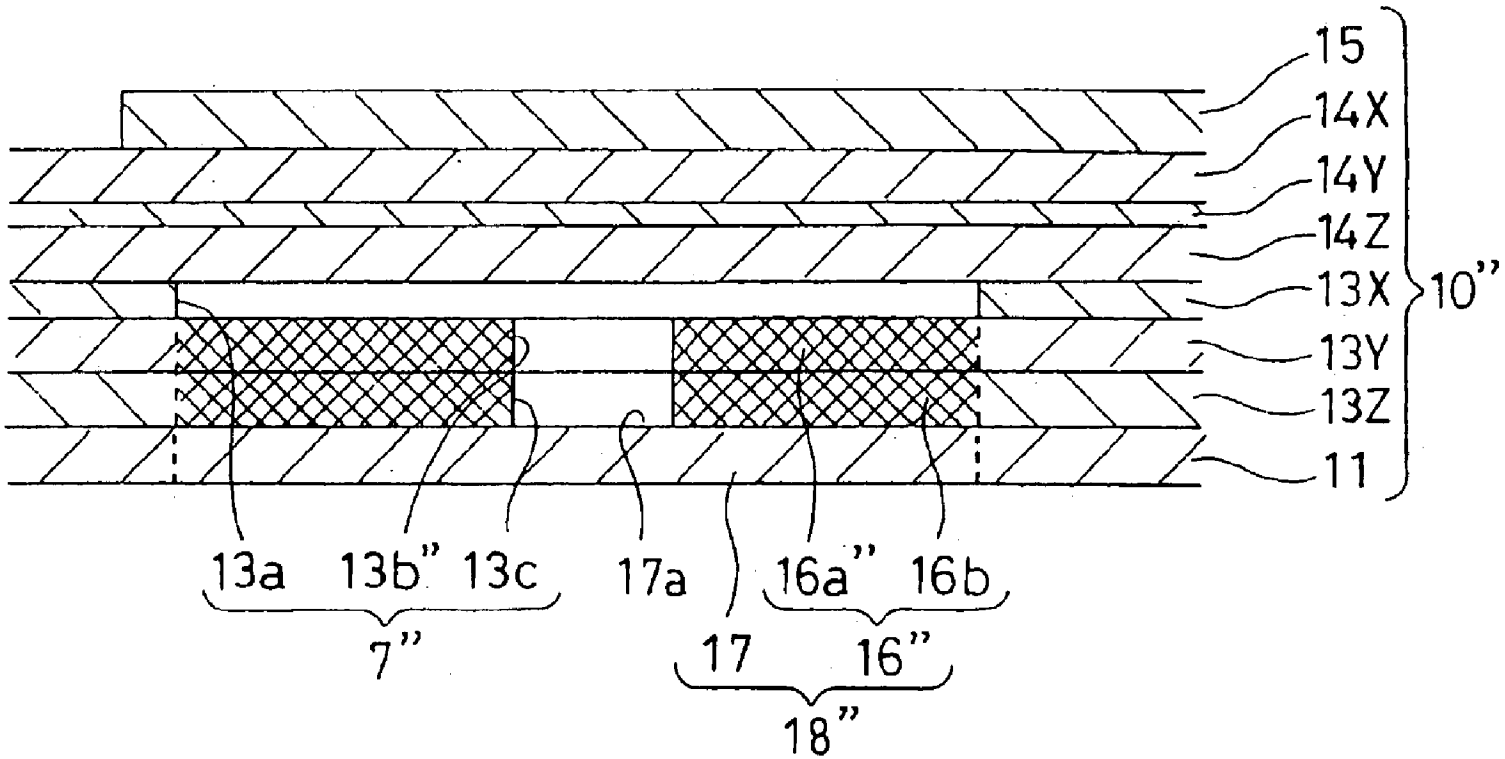
FIG. 13 is an enlarged sectional view of a passage unit in an ink-jet head according to a second modification of the first embodiment of the present invention, corresponding to FIG. 8.
Figure 14:
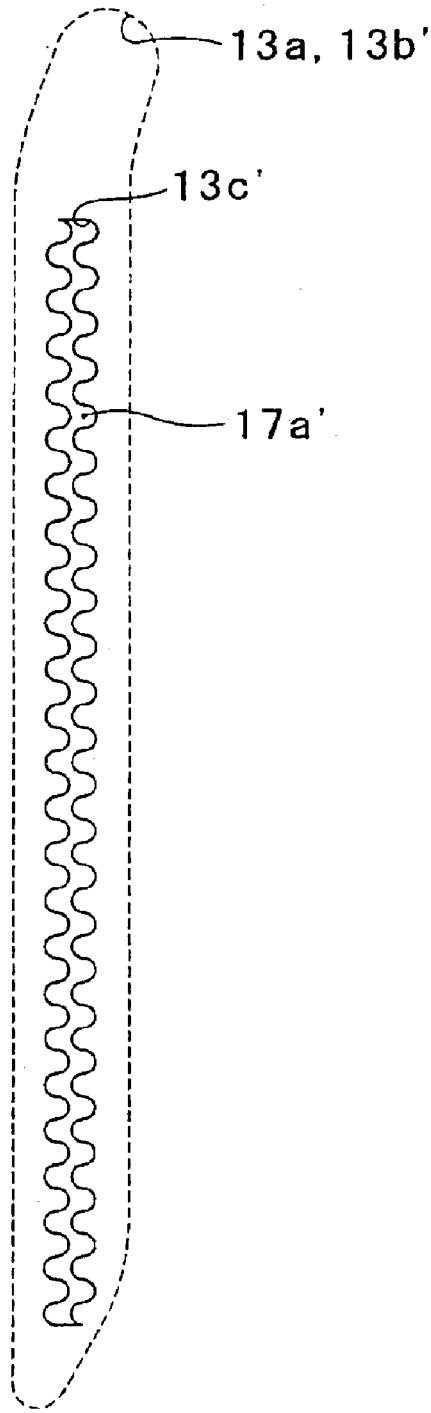
FIG. 14 is a schematic plan view of a common ink chamber in an ink-jet head according to a third modification of the first embodiment of the present invention.

Next, modifications of the ink-jet head according to the first embodiment of the present invention will be described with reference to FIGS. 12 to 14. In FIGS. 12 to 14, the same components as in the above embodiment are denoted by the same reference numerals as in the above embodiment, respectively.

FIG. 12 is an enlarged sectional view of a passage unit 10' in an ink-jet head according to a first modification, corresponding to FIG. 8. As illustrated in FIG. 12, in this modification, a bottom wall 181 of a common ink chamber 7' made up of an ink chamber upper portion 13*a,* an ink chamber middle portion 13*b*', and an ink chamber lower portion 13*c* has a cross section of a stepped shape, in which a bottom face 17*a* central in plane is the closest to the nozzle open face 10*a* and a single step is formed on either side of the bottom face 17*a*. More specifically, the inner walls of two manifold plates 13X and 13Y are substantially at the same position, and the bottom wall 18' includes a bottom portion 17 in a region of the nozzle plate 11 corresponding to the ink chamber upper portion 13*a,* and a reinforcement portion 16' (illustrated with cross-hatching in FIG. 12) made of a portion 16*b* of the manifold plate 13Z protruding inward beyond the inner walls of the manifold plates 13X and 13Y.

In this modification, the common ink chamber 7' is larger in volume than the common ink chamber 7 of the first embodiment by the increase in volume of the ink chamber middle portion 13*b*'. Therefore, further smooth and even ink supply to each pressure chamber can be realized.

FIG. 13 is an enlarged sectional view of a passage unit 10" in an ink-jet head according to a second modification, corresponding to FIG. 8. As illustrated in FIG. 13, in this modification, a bottom wall 18" of a common ink chamber 7" made up of an ink chamber upper portion 13*a,* an ink chamber middle portion 13*b*2, and an ink chamber lower portion 13*c* has a cross section of a stepped shape, in which a bottom face 17*a* central in plane is the closest to the nozzle open face 10*a* and a single step is formed on either side of the bottom face 17*a*. More specifically, the inner walls of two manifold plates 13Y and 13Z are substantially at the same position, and the bottom wall 18" includes a bottom portion 17 in a region of the nozzle plate 11 corresponding to the ink chamber upper portion 13*a,* and a reinforcement portion 16" (illustrated with cross-hatching in FIG. 13) made up of portions 16*a*" and 16*b* of the respective manifold plates 13Y and 13Z protruding inward beyond the inner wall of the manifold plate 13X.

In this modification, the reinforcement effect of the reinforcement portion 16" is improved by the portion 16*a*" extending more than the portion 16*a* of the above-described first embodiment. Thus, the strength of the passage unit 10" against capping force is very superior.

FIG. 14 illustrates a schematic plan view of a common ink chamber in an ink-jet head according to a third modification. In this modification, the reinforcement portion 16 of the above-described first modification is further modified such that the bottom face (denoted by reference 17*a*' in this modification) takes a rounded zigzag shape. In FIG. 14, a broken line represents the position of the inner walls of the ink chamber upper and middle portions 13*a* and 13*b*', and a solid line s represents the position of the inner wall of the ink chamber lower portion (denoted by reference 13*c*' in this modification). The term "zigzag shape" means that an arbitrary straight line extending on the bottom face 17*a*' along the length of the bottom face 17*a*' has periodically portions overlapping the bottom face 17*a*' and portions not overlapping the bottom face 17*a'*.

As apparent from FIG. 14, in this modification, because the bottom face 17*a*' has the zigzag shape along the length of the common ink chamber, the lip 81*b* of the purge cap 81 is in contact with the portion of the nozzle open face 10*a* below the reinforcement portion 16 and the portion of the nozzle open face 10*a* below the bottom face 17*a*' alternately in the length of the lip 81*b*. That is, the lip 81*b* is not continuously in contact with the portion of the nozzle open face 10*a* corresponding to the bottom face 17*a*'. As a result, the strength of the passage unit against the capping force considerably increases. Therefore, because a relatively small volume of reinforcement portion suffices, a large cross-sectional area of the common ink chamber 7 can be ensured. This can realize an ink-jet head more superior in ink ejection performance.

In this modification, the bottom face 17*a*' takes a rounded zigzag shape. However, the bottom face 17*a*' may take an angular zigzag shape. Further, the pitch of the zigzag shape can be varied. However, because the strength reduces as the pitch increases, the pitch is preferably as small as possible within the range of manufacturability. Furthermore, this modification is based on the first modification. However, for example, the above-described first embodiment or second modification can adopt a design like FIG. 14.

In the first embodiment, the reinforcement portion has a stepped shape. However, the shape of the reinforcement portion is not limitative. The reinforcement portion can have an arbitrary shape if it includes a portion not parallel to the nozzle open face 10*a*. Further, the bottom face of each common ink chamber need not always be central of the common ink chamber. For example, the bottom face of each common ink chamber may be in an end portion of the common ink chamber. Furthermore, in the first embodiment, the portion of the upper face of the nozzle plate 11 exposed to each common ink chamber 7 is the bottom face 17*a*. However, for example, no through-hole may be formed in the manifold plate 13Z so that the upper face of the manifold plate 13Z is the bottom face.

Further, in the first embodiment, the plural plates are put in layers to form the passage unit. In this case, the number of plates can be changed. Also, the number of manifold plates can be changed. Further, each common ink chamber may be formed as a groove in a single plate.

In addition, in the first embodiment, the width of the nozzle plate is the same as those of the other plates. However, the width of the nozzle plate may be decreased so as to include only a portion near the nozzles and the other portion of the nozzle plate may be covered with a protective member higher in strength than the nozzle plate. According to the present invention, however, because the strength of the passage unit is improved, there is less necessity of such a change in design.

Further, in the first embodiment, the actuator unit is laminated with piezoelectric sheets on each of which electrodes are printed. However, the actuator unit is not limited to such a construction. The actuator unit can have any construction other than such a piezoelectric type if it includes active portions deformable to change the volume of each pressure chamber.

Figure 15:
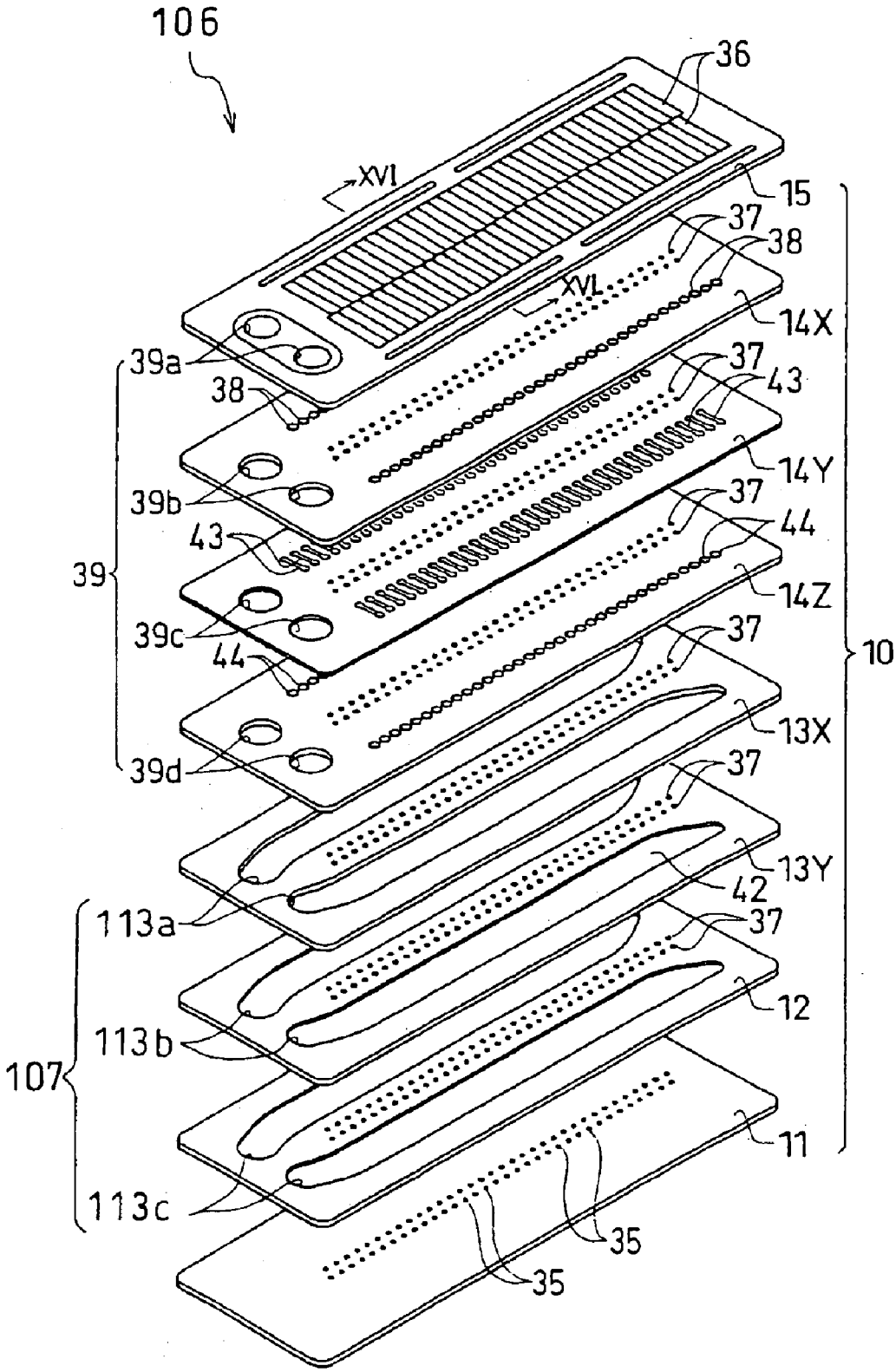
FIG. 15 is an exploded perspective view of a passage unit as a part of an ink-jet head included in an ink-jet printer according to a second embodiment of the present invention.
Figure 16:
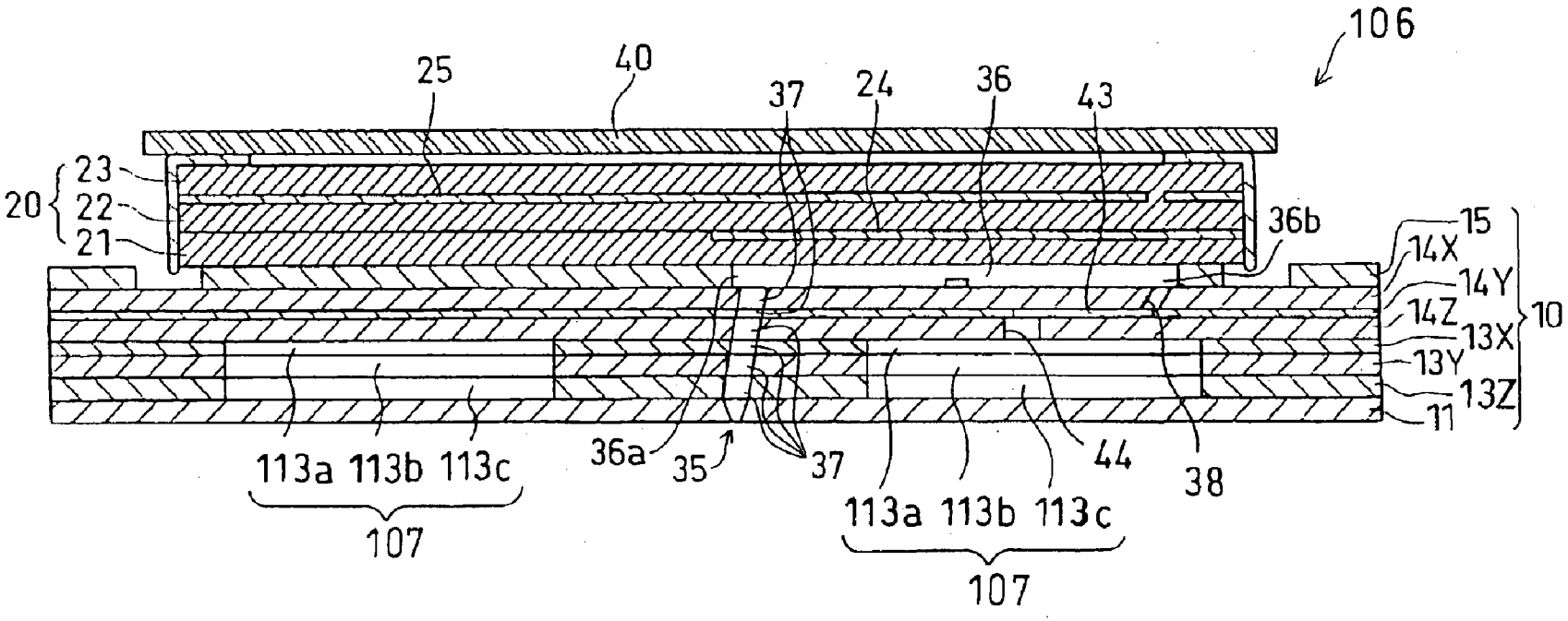
FIG. 16 is an enlarged sectional view taken along line XVI—XVI in FIG. 15.

Next, an ink-j et printer according to a second embodiment of the present invention will be described. The general construction of the ink-jet printer according to this embodiment is substantially the same as that of the ink-jet printer 1 of FIG. 1. Hereinafter, therefore, only the feature of the ink-jet printer according to this embodiment different from the ink-jet printer 1 of the first embodiment will be described and the same components as in the first embodiment are denoted by the same reference numerals as in the first embodiment to omit the description, First, an ink-jet head included in the ink-jet printer according to this embodiment will be described. FIG. 15 illustrates an exploded perspective view of an ink-jet head 106 according to this embodiment. FIG, 16 illustrates an enlarged sectional view taken along line XVI—XVI in FIG. 15. The ink-jet head 106 differs from the ink-jet head 6 of the first embodiment in shape of each common ink chamber. More specifically, as apparent from FIG. 16, each common ink chamber 107 in the ink-jet head 106 has a rectangular cross section along the width of the passage unit. That is, each ink chamber upper portion 113*a* formed in the manifold plate 13X, each ink chamber middle portion 113*b* formed in the manifold plate 13Y, and each ink chamber lower portion 113*c* formed in the manifold plate 13Z have substantially the same shape. Therefore, the cross-sectional area of each common ink chamber 107 along the width of the passage unit is considerably larger than that of the first embodiment on the other hand, no stepped reinforcement portion exists in the passage unit 10 of the ink-jet head 106. Therefore, the strength of the bottom wall of each common ink chamber in the passage unit 10 against capping force is relatively low.

Figure 17:
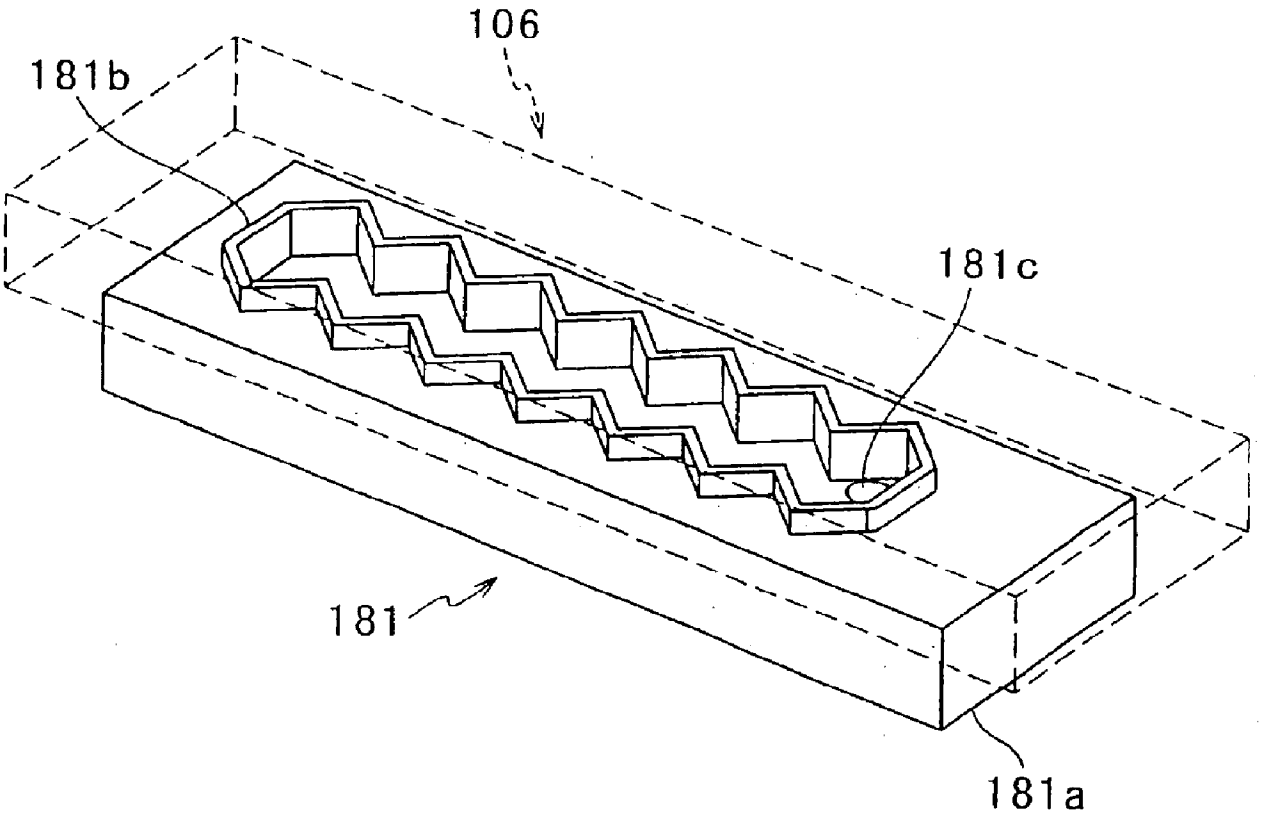
FIG. 17 is a perspective view of a purge cap included in the ink-jet printer according to the second embodiment of the present invention.
Figure 18:
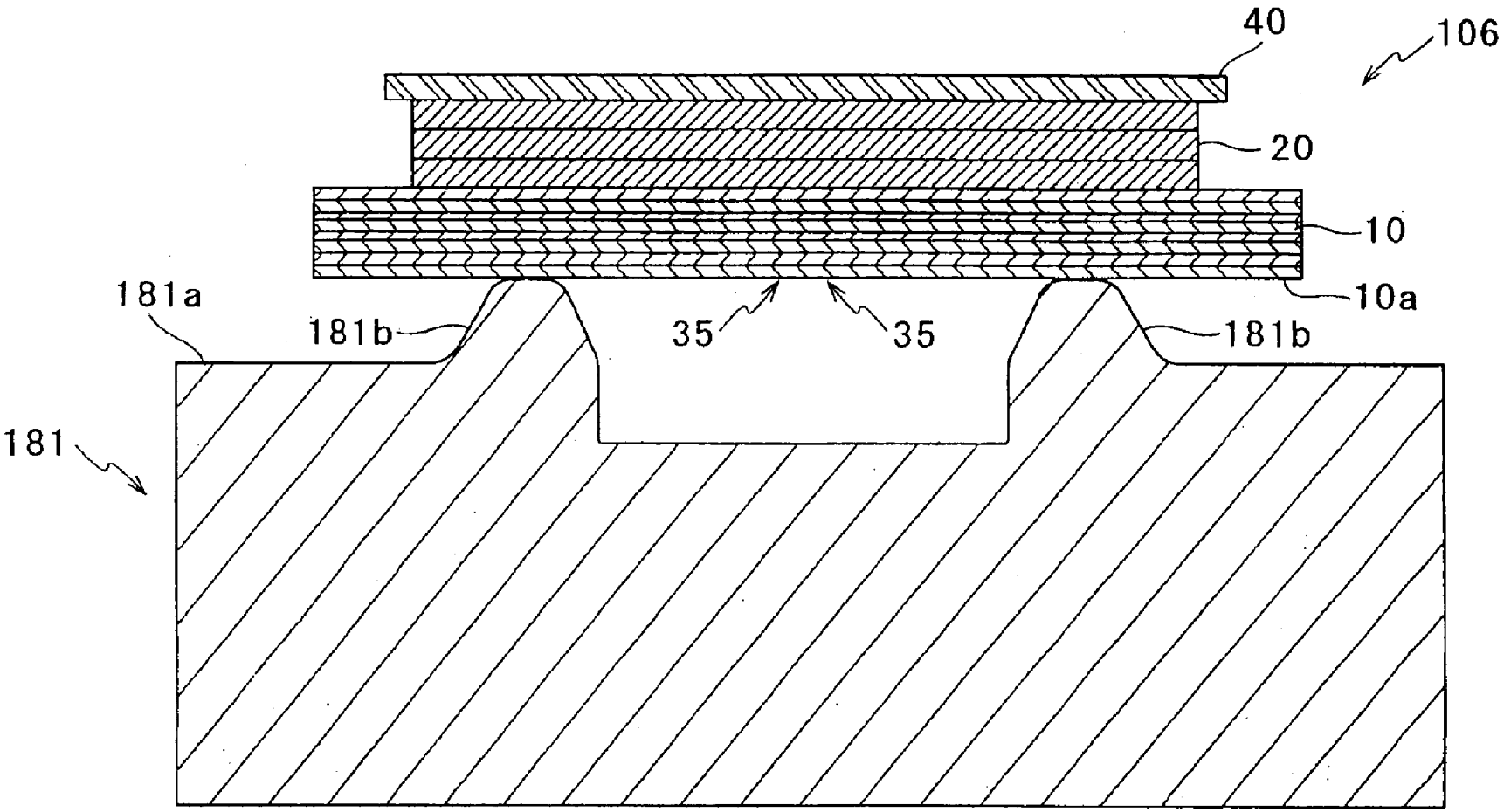
FIG. 18 is a sectional view illustrating a state that nozzles of the ink-jet head are covered with the purge cap according to the second embodiment of the present invention.
Figure 19:
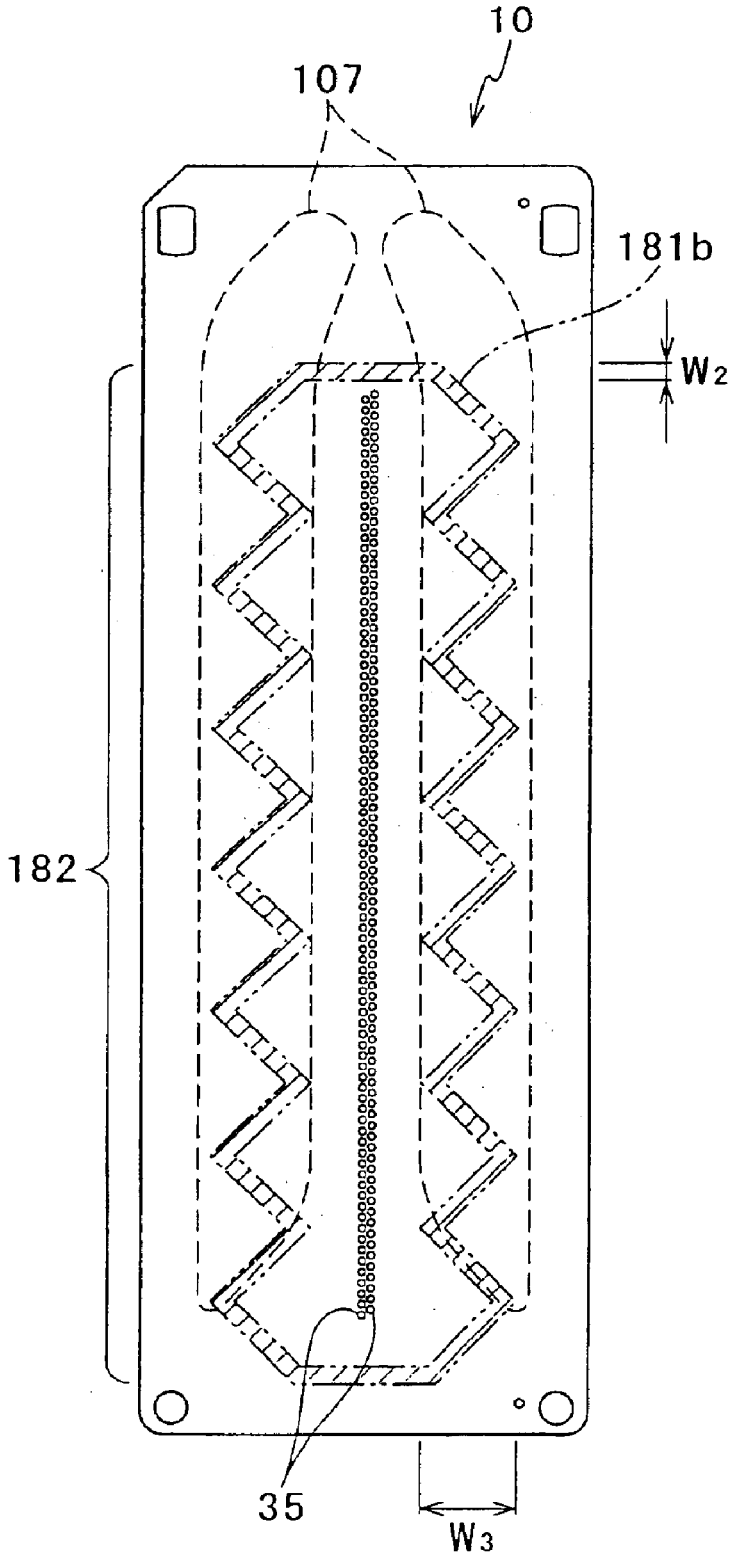
FIG. 19 is a bottom view of the passage unit showing the positional relation in plane between the purge cap and the passage unit according to the second embodiment of the present invention.

Next, a purge cap 181 included in the ink-jet printer according to this embodiment will be described. FIG. 17 illustrates a perspective view of the purge cap 181. FIG. 18 is a sectional view illustrating a state that nozzles of an ink-jet head are covered with the purge cap 181. FIG. 19 illustrates a bottom view of the passage unit 10 showing the positional relation in plane between the purge cap 181 and the passage unit 10.

Referring to FIG. 17, the purge cap 181 is made up of a is substantially rectangular parallelepiped main body 181*a* and an annular lip 181*b* protruding from the upper face of the main body 181*a* for surrounding nozzle rows. A hole 181*c* connected to a pump 82 is formed in the upper face of the main body 181*a* within the area surrounded by the lip 181*b*. The width of the tip end of the lip 181*b* is constant as $W_2$ in any portion.

In the lip 181*b*, the portion 182 to be opposed to each end of the passage unit 10 in the width of the passage unit 10 does not extend in a straight line along the length of the passage unit 10 but it is made into a zigzag shape. More specifically, the portion 182 of the lip 181*b* extends alternately inward at 45 degrees from the length of the passage unit 10 and outward at 45 degrees from the length of the passage unit 10 to form a zigzag shape. The width $W_3$ of the zigzag shape of the portion 182 of the lip 181*b* along the width of the passage unit 10 (perpendicular to the rows of nozzles 35) is substantially equal to the width of each common ink chamber 107.

When the head assembly 63 is at the reset position, the tip end of the lip 181*b* is in contact with the nozzle open face 10*a* of the passage unit 10 as illustrated in FIG. 18. The shape of the lip 181*b* is designed such that the lip 181*b* surrounds all nozzles 35. At this time, as apparent from FIG. 19, the portions 182 of the lip 181*b* are at the positions corresponding to the respective common ink chambers 107 in the width of the passage unit 10.

In the ink-jet printer of this embodiment, even when a relatively large capping force is applied to the passage unit 10 by the cap 181, because the area of the portion 182 of the lip 181*b* corresponding to each common ink chamber 107 is larger than that in case of the portion 182 of the lip 181*b* extending in a straight line along the length of the passage unit 10, the capping pressure applied to the nozzle plate 11 as the bottom wall of each common ink chamber 107 is relatively low. Therefore, even when the cross section of each common ink chamber 107 along the width of the passage unit 10 is rectangular and the bottom wall of each common ink chamber 107 is thin, the bottom wall of each common ink chamber 107 is scarcely deformed due to the capping force. Thus, the bottom wall of each common ink chamber 107 can be made thin with preventing the bottom wall of each common ink chamber 107 from being deformed by the capping force. This can realize a decrease in size of the ink-jet head 106 or an increase in the cross-sectional area of each common ink chamber 107.

In this embodiment, each portion 182 is made into an angular zigzag shape. However, each portion 182 may be made into a rounded zigzag shape. Further, the pitch of the zigzag shape can be varied. However, because the strength reduces as the pitch increases, the pitch is preferably as small as possible within the range of manufacturability. Furthermore, each portion 182 may not always be made into a zigzag shape. The above advantage can be obtained if each portion 182 has a portion not parallel to the length of each common ink chamber 107.

Next, an ink-jet printer according to a third embodiment of the present invention will be described. The ink-jet printer according to this embodiment differs from the ink-jet printer of the second embodiment only in shape of purge cap, and the other construction of the ink-jet printer according to this embodiment is substantially the same as that of the second embodiment. Hereinafter, therefore, only a purge cap included in the ink-jet printer according to this embodiment will be described and the same components as in the first and second embodiments are denoted by the same reference numerals as in the first and second embodiments to omit the description.

Figure 20:
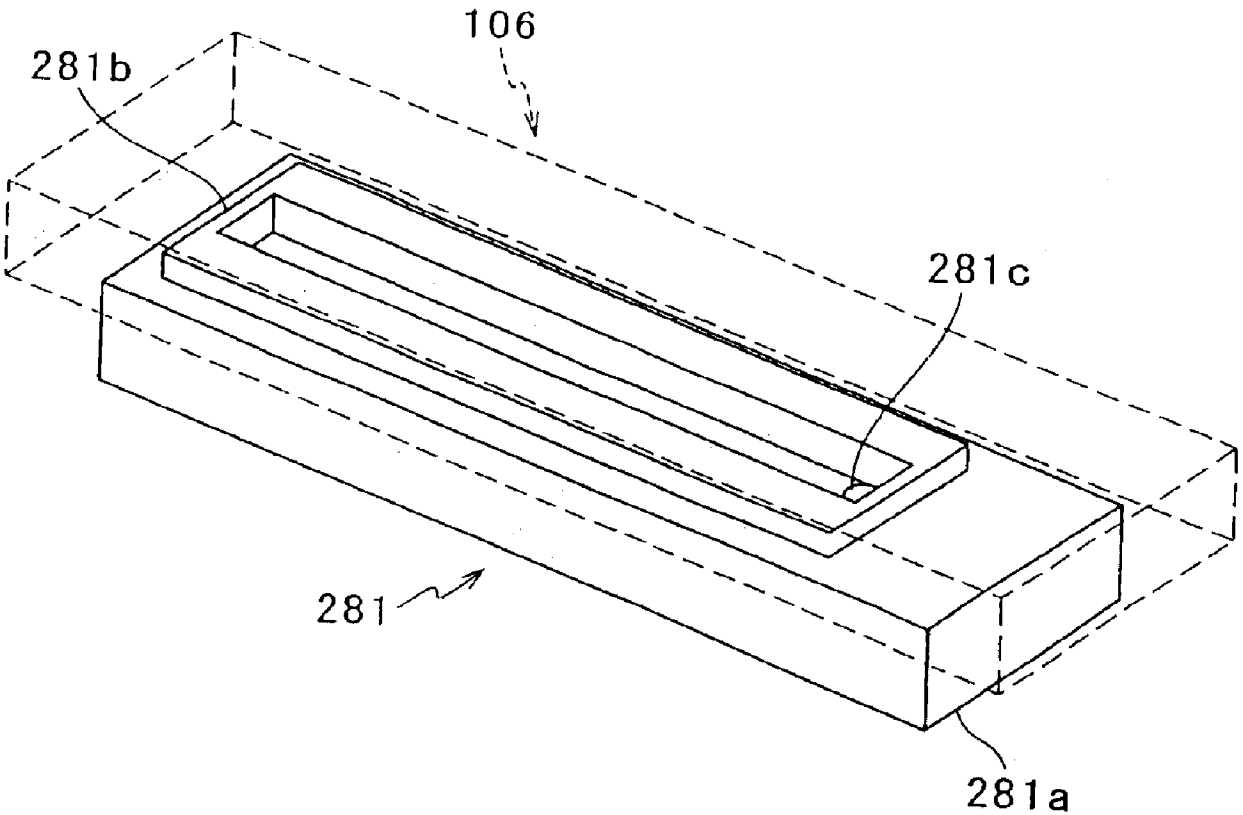
FIG. 20 is a perspective view of a purge cap included in an ink-jet printer according to a third embodiment of the present invention.
Figure 21:
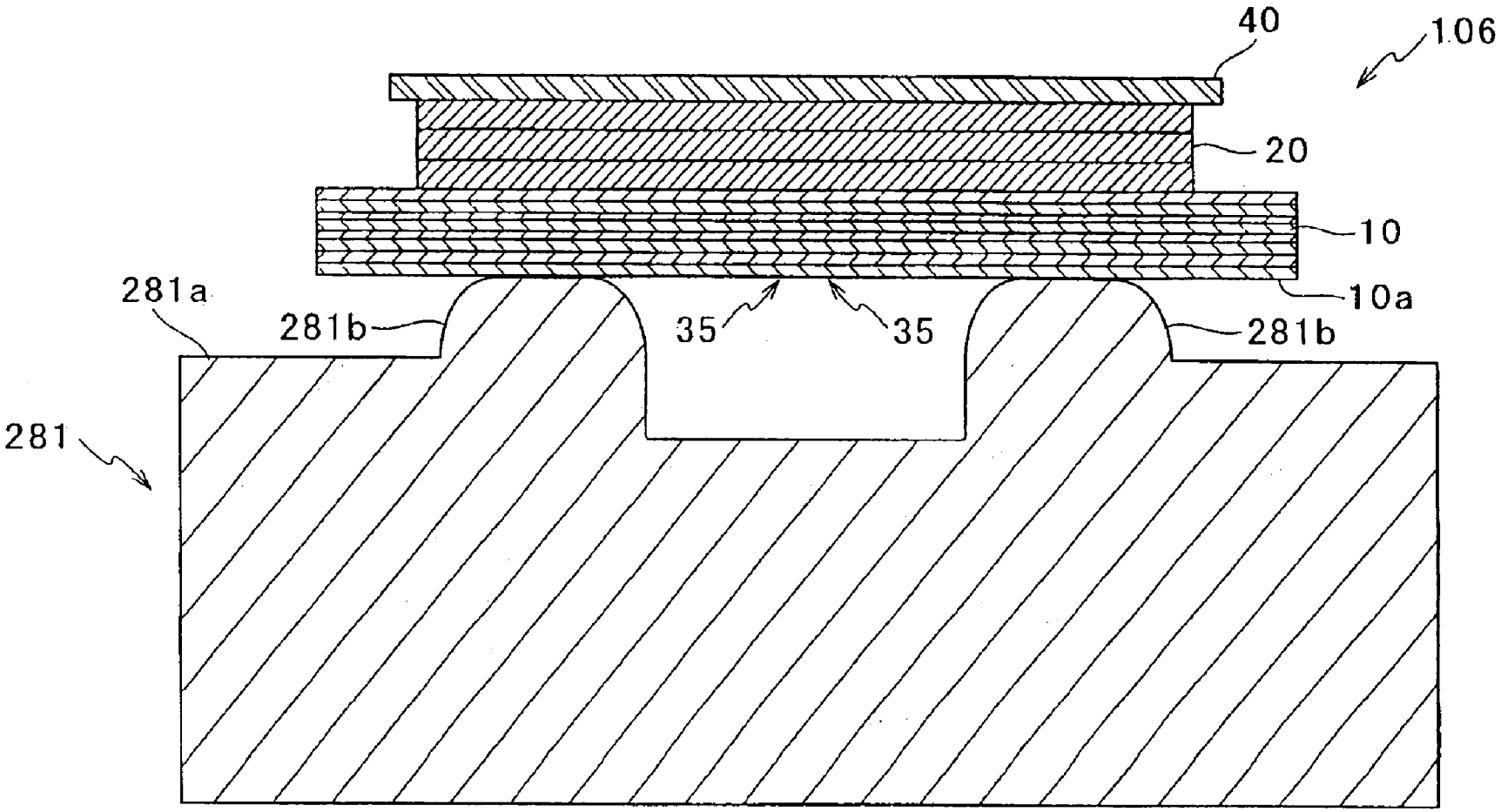
FIG. 21 is a sectional view illustrating a state that nozzles of an ink-jet head are covered with the purge cap according to the third embodiment of the present invention.
Figure 22:
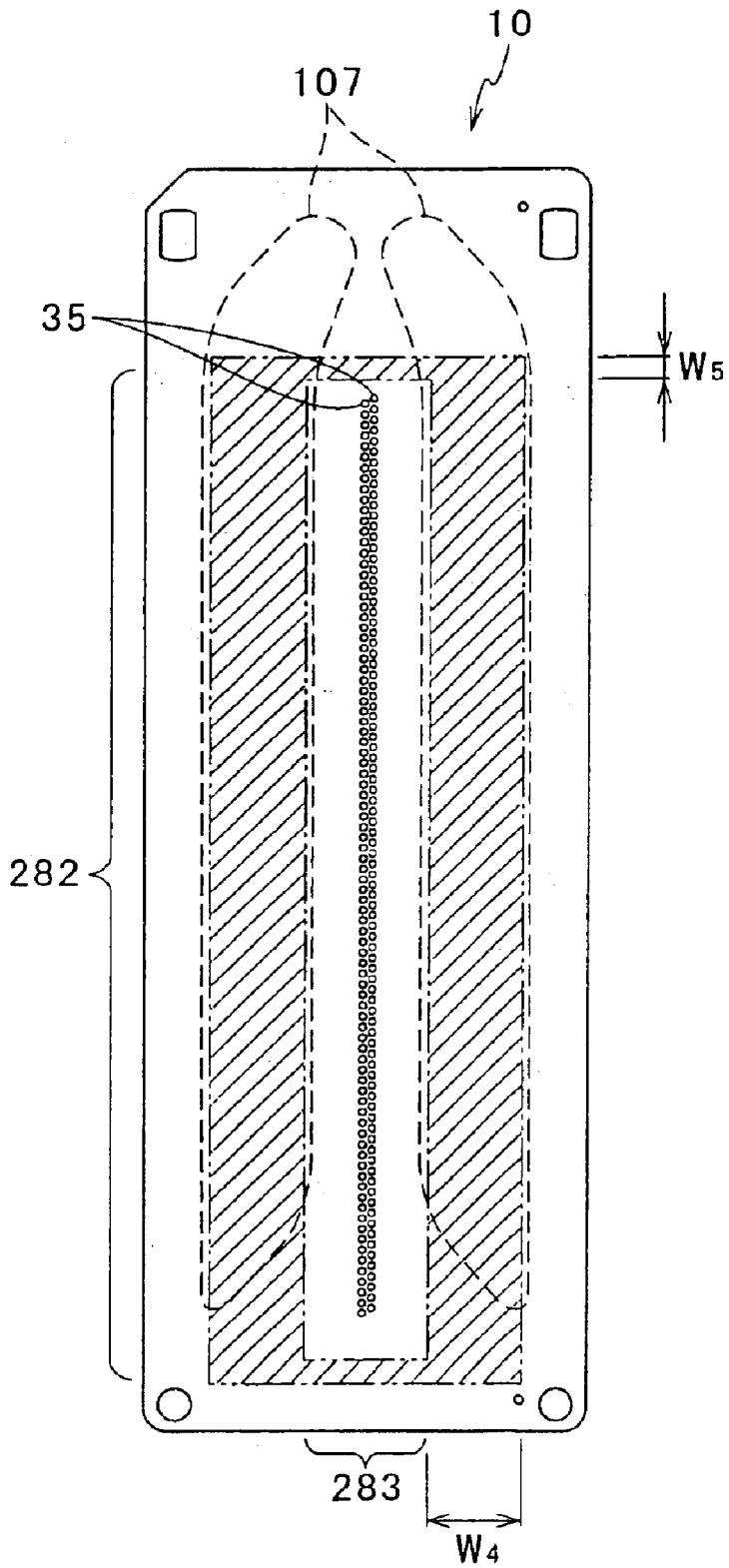
FIG. 22 is a bottom view of a passage unit showing the positional relation in plane between the purge cap and the passage unit according to the third embodiment of the present invention.

FIG. 20 illustrates a perspective view of a purge cap 281 included in the ink-jet printer according to this embodiment. FIG. 21 is a sectional view illustrating a state that nozzles of an ink-jet head are covered with the purge cap 281. FIG. 22 illustrates a bottom view of the passage unit 10 showing the positional relation in plane between the purge cap 281 and the passage unit 10.

Referring to FIG. 20, the purge cap 281 is made up of a substantially rectangular parallelepiped main body 281*a* and an annular rectangular lip 281*b* protruding from the upper face of the main body 281*a* for surrounding nozzle rows. A hole 281*c* connected to a pump 82 is formed in the upper face of the main body 281*a* within the area surrounded by the lip 281*b*.

As illustrated in FIG. 20, the lip 281*b* protrudes upward from the upper face of the main body 281*a* such that each longer side of the lip 281*b* is rectangular along the length of the purge cap 281. In the lip 281*b*, the width of the portion to be opposed to each end of the passage unit 10 in the width of the passage unit 10, that is, the width $W_1$ of the portion 282 along the length of each common ink chamber 107 (the length of the portion 282 along the width of the passage unit 10) is larger than the width of the portion to be opposed to each end of the passage unit 10 in the length of the passage unit 10, that is, the width $W_5$ of the portion 283 substantially perpendicular to the length of each common ink chamber 107 (the length of the portion 283 along the length of the passage unit 10). In short, each portion 282 is thicker than each portion 283. The width $W_4$ of each portion 282 is substantially equal to the width of each common ink chamber 107.

When the head assembly 63 is at the reset position, the tip end of the lip 281*b* is in contact with the nozzle open face 10*a* of the passage unit 10 as illustrated in FIG. 21. The shape of the lip 281*b* is designed such that the lip 281*b* surrounds all nozzles 35. At this time, as apparent from FIG. 22, the portions 282 of the lip 281*b* are at the positions corresponding to the respective common ink chambers 107 in the width of the passage unit 10.

In this embodiment, the width $W_5$ of each portion 283 of the lip 218*b* is relatively small. Therefore, the length of the cap 281 can be decreased. This can realize a decrease in size of the ink-jet printer.

In the ink-jet printer of this embodiment, even when a relatively large capping force is applied to the passage unit 10 by the cap 281, because the width $W_4$ of each portion 282 of the lip 281*b* is larger than the width $W_5$ of each portion 283 of the lip 281*b* and the area of the portion 282 of the lip 281*b* corresponding to each common ink chamber 107 is large accordingly, the capping pressure applied to the nozzle plate 11 as the bottom wall of each common ink chamber 107 is relatively low in comparison with a case of the width $W_4$ of each portion 282 of the lip 281*b* being as small as the width $W_5$ of each portion 283 of the lip 281*b*.

Therefore, even when the cross section of each common ink chamber 107 along the width of the passage unit 10 is rectangular and the is bottom wall of each common ink chamber 107 is thin, the bottom wall of each common ink chamber 107 is scarcely deformed due to the capping force. Thus, the bottom wall of each common ink chamber 107 can be made thin with preventing the bottom wall of each common ink chamber 107 from being deformed by the capping force. This can realize a reduction in size of the ink-jet head 106 or an increase in the cross-sectional area of each common ink chamber 107.

As illustrated in FIG. 22, in the ink-jet printer of this embodiment, the whole width of the bottom wall of each common ink chamber 107 is opposed to the corresponding portion 282 of the lip 281*b*. However, when the width $W_5$ of each portion 283 of the lip 218*b* is relatively small in comparison with the width of each common ink chamber 107, if the width of the region where the bottom wall of each common ink chamber 107 is opposed to the corresponding portion 282 of the lip 281*b* is larger than the width $W_5$ of each portion 283 of the lip 281*b*, the effect of suppressing the deformation of the bottom wall can be expected to some extent. Further, if the width of the region where the bottom wall of each common ink chamber 107 is opposed to the corresponding portion 282 of the lip 281*b* is not less than a half of the width of each common ink chamber 107, a sufficient effect of suppressing the deformation of the bottom wall can be obtained. Thus, in the ink-jet printer of this embodiment, by making the width $W_5$ of each portion 283 of the lip 218*b* relatively small and making the width of the region where the bottom wall of each common ink chamber 107 is opposed to the corresponding portion 282 of the lip 281*b*, larger than the width $W_5$ of each portion 283 of the lip 218*b*, a reduction in size of the ink-jet printer and suppression of deformation of the bottom wall of each common ink chamber are realized together.

The shape of the tip end of the lip to be in contact with the portion of the nozzle plate below each common ink chamber is not limited to such a zigzag shape or a thick shape as in the above-described second or third embodiment. For example, the lip may have a contact face in a shape extending radially from a portion for protecting nozzles. That is, the tip end of the lip may have a shape such that the portion of the lip corresponding to each common ink chamber 107 has a large contact area to the nozzle open face and the capping force propagated to the bottom wall of each common ink chamber 107 can be dispersed.

In the above-described embodiments, each pressure generation portion in the actuator unit utilizes the piezoelectric effect. However, the present invention is not limited to this. For example, electrostatic pressure generation portions maybe used. Further, each plate 11 to 14 is not limited to metal. For example, they may be made of a resin or is the like.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet printer comprising:

a flat passage unit including a plurality of pressure chambers arranged along a first flat face of the passage unit, a plurality of nozzles each open in a second flat face of the passage unit opposite to the first flat face, the nozzles being connected to the respective pressure chambers, and a common ink chamber extending substantially along an arrangement of the plurality of nozzles, the common ink chamber being connected to each of the plurality of pressure chambers to supply ink to the pressure chambers;

an actuator unit for applying ejection pressure to ink in each of the plurality of pressure chambers; and a cap including an annular lip to be in contact with the second flat face of the passage unit when printing is not performed, at least part of the lip opposite to the common ink chamber being zigzag-shaped in a plane parallel to the second flat face.

2. The ink-jet printer according to claim 1, wherein a zigzag-shaped portion of the lip extends substantially along a length of the common ink chamber.

3. The ink-jet printer according to claim 2, wherein a width of the zigzag-shaped portion is substantially the same as a width of the common ink chamber, and the whole of the zigzag-shaped portion is opposed to the common ink chamber.

4. An ink-jet printer comprising:

a flat passage unit including a plurality of pressure chambers arranged along a first flat face of the passage unit, a plurality of nozzles each open in a second flat face of the passage unit opposite to the first flat face, the nozzles being connected to the respective pressure chambers, and a common ink chamber extending substantially along an arrangement of the plurality of nozzles, the common ink chamber being connected to each of the plurality of pressure chambers to supply ink to the pressure chambers;

an actuator unit for applying ejection pressure to ink in each of the plurality of pressure chambers; and a cap including an annular lip to be in contact with the second flat face of the passage unit when printing is not performed, a portion of the lip opposite to the common ink chamber having a part not parallel to a length of the common ink chamber.

5. An ink-jet printer comprising:

a flat passage unit including a plurality of pressure chambers arranged along a first flat face of the passage unit, a plurality of nozzles each open in a second flat face of the passage unit opposite to the first flat face, the nozzles being connected to the respective pressure chambers, and a common ink chamber extending substantially along an arrangement of the plurality of nozzles, the common ink chamber being connected to each of the plurality of pressure chambers to supply ink to the pressure chambers;

an actuator unit for applying ejection pressure to ink in each of the plurality of pressure chambers; and a cap including an annular lip to be in contact with the second flat face of the passage unit when printing is not performed, a width of a portion of the lip opposite to the common ink chamber being larger than a width of a portion of the lip not opposite to the common ink chamber.

6. The ink-jet printer according to claim 5, wherein the width of the portion of the lip opposite to the common ink chamber is not less than a half of a width of the common ink chamber.

7. The ink-jet printer according to claim 5, wherein the width of the portion of the lip opposite to the common ink chamber is not less than a width of the common ink chamber.

8. An ink-jet printer comprising:

a flat passage unit including a plurality of pressure chambers arranged along a first flat face of the passage unit, a plurality of nozzles each open in a second flat face of the passage unit opposite to the first flat face, the nozzles being connected to the respective pressure chambers, and a common ink chamber extending substantially along an arrangement of the plurality of nozzles, the common ink chamber being connected to each of the plurality of pressure chambers to supply ink to the pressure chambers;

an actuator unit for applying ejection pressure to ink in each of the plurality of pressure chambers; and a cap including an annular rectangular lip to be in contact with the second flat face of the passage unit when printing is not performed, a width of a portion of the lip along a length of the common ink chamber being larger than a width of a portion of the lip substantially perpendicular to the length of the common ink chamber.

* * * * *